US012677893B1

(12) United States Patent
Shani

(10) Patent No.: US 12,677,893 B1
(45) Date of Patent: Jul. 14, 2026

(54) ADJUSTABLE DECORATIVE DRAWSTRING

(71) Applicant: Rocknot LLC, Sherman Oaks, CA (US)

(72) Inventor: Orly Shani, Sherman Oaks, CA (US)

(73) Assignee: Rocknot LLC, Sherman Oaks (CA)

( * ) Notice: Subject to any disclaimer, the term of this patent is extended or adjusted under 35 U.S.C. 154(b) by 0 days.

(21) Appl. No.: 19/383,744

(22) Filed: Nov. 9, 2025

Related U.S. Application Data

(60) Provisional application No. 63/829,711, filed on Jun. 24, 2025.

(51) Int. Cl.
*A43C 9/06* (2006.01)
*A41D 27/08* (2006.01)

(52) U.S. Cl.
CPC ..... *A41D 27/08* (2013.01); *A41D 2300/33* (2013.01)

(58) Field of Classification Search
CPC ..... A43C 11/12; A43C 11/008; A43C 9/06; A41D 27/08; A41D 2300/33
See application file for complete search history.

(56) References Cited

U.S. PATENT DOCUMENTS 4,334,413 A * 6/1982 Gaston ..... A44C 5/22 63/3.2
4,671,437 A * 6/1987 Sauger ..... D05B 91/02 223/102
5,524,800 A * 6/1996 Arney ..... D05B 91/02 2/243.1
5,956,774 A * 9/1999 Mackley ..... A41D 1/089 2/238
5,970,526 A * 10/1999 Weathers ..... A41F 9/002 2/920
9,301,580 B1 * 4/2016 Rafaelian ..... A44B 11/04
9,392,849 B1 * 7/2016 Makhoulian ..... A44C 7/003
10,299,539 B2 5/2019 Finley
2008/0229563 A1 * 9/2008 Cohen ..... A43C 9/04 24/715.4
2008/0295305 A1 * 12/2008 Hsu ..... A43C 9/04 24/715.6

(Continued)

FOREIGN PATENT DOCUMENTS

CA 2802416 A1 * 7/2017 ..... A43C 9/06
JP 2002191251 A * 7/2002

(Continued)

OTHER PUBLICATIONS

"How they work." Hoodlaces.com. Available at: https://www.hoodlaces.com/how-they-work/ (Accessed: Dec. 2, 2025).

*Primary Examiner* — Tajash D Patel
(74) *Attorney, Agent, or Firm* — Blank Rome LLP

(57) ABSTRACT

A drawstring for a garment includes fasteners for receiving select decorative elements. The length of the drawstring is such that when installed within a garment, only the decorative elements are exposed outside the garment. The fasteners and the drawstring reside within the garment and are therefore hidden from view. The drawstring can either be cut to a predetermined length, or can be provided in sections with structure to secure each section to each other at predetermined relative locations so that the overall length of the combine sections can be adjustable, as desired.

11 Claims, 15 Drawing Sheets

(56) References Cited

U.S. PATENT DOCUMENTS

| | | | | |
|---|---|---|---|---|
| 2014/0033486 | A1* | 2/2014 | Beaufrere | A43C 9/06<br>24/715.6 |
| 2018/0055148 | A1* | 3/2018 | Finley | A43C 9/06 |
| 2024/0041161 | A1* | 2/2024 | Cheng | A43C 9/06 |
| 2025/0064172 | A1* | 2/2025 | Dupre | A43C 9/06 |

FOREIGN PATENT DOCUMENTS

| | | | | |
|---|---|---|---|---|
| WO | WO-2012040860 | A1 * | 4/2012 | A44C 5/208 |
| WO | WO-2016019234 | A1 * | 2/2016 | A41F 17/02 |

* cited by examiner

ADJUSTABLE DECORATIVE DRAWSTRING

CROSS-REFERENCE TO RELATED APPLICATIONS

This application claims priority to U.S. Provisional Patent Application No. 63/829,711, filed Jun. 24, 2025, entitled "Adjustable Decorative Drawstring," the entire disclosure of which is incorporated herein by reference.

BACKGROUND OF THE INVENTION a) Field of the Invention

The present disclosure relates generally to drawstring systems of the type that can be used with various types of clothing, such as hoodies, sweatpants, and jackets and, in particular, to such drawstring systems that are configured to be adorned with decorations.

b) Description of the Related Art

Drawstrings, traditionally used as functional elements to adjust the fit of garments such as hoodies, sweatpants, and jackets, have evolved into a canvas for creative expression in contemporary fashion. While their original purpose was purely utilitarian, to tighten or loosen garments for comfort and fit, or close off otherwise open sections of a garment, they are now increasingly treated as an aesthetic component that can enhance the overall style and uniqueness of an apparel piece.

In recent years, decorated drawstrings have become a trend in both street-wear and high fashion, with designers incorporating various embellishments such as beads, embroidery, printed patterns, colored tips (aglets), various charms, and custom braiding. These small yet impactful design touches offer a subtle way to convey brand identity, add personality, or elevate the garment's perceived value.

As personalization continues to drive fashion innovation, drawstring decoration provides an easy and cost-effective method for customization. Whether through DIY approaches for individual expression or mass production in branded collections, decorative drawstrings allow for endless creative possibilities while maintaining functionality. This blend of practicality and style has made them a popular focal point in modern garment design.

Taking a common hooded sweatshirt (commonly called a "hoodie"), for example, it includes one long drawstring that passes through a channel formed in the construction around the rim portion of the hood, around the opening through which the user's face resides, when the hood is deployed over the user's head, when wearing the garment. The hoodie drawstring is typically long and includes an exposed length of about 4-8 inches (about 10-20 centimeters) extending outside the garment on each side of the garment's hood. It is to these exposed ends of the hoodie drawstring, that typically dangle about the wearer's chest, in this example, that ornaments are selectively attached by the user. One method commonly used to decorate the drawstrings of a hoodie, is to simply clip-on or otherwise secure a decorative ornament to the exposed ends of the original drawstring that came with the particular hoodie. Although this type of drawstring decoration is easy to accomplish, the fact that the drawstring remains the original length diminishes the decorative impact and uniqueness of the added ornaments. It will be readily apparent to third-party observers that the wearer merely clipped on temporary decorations to the exposed ends of the original drawstring, providing a disjointed and interrupted look and appearance. If the wearer of a garment desired a unique decorative look and wanted to shorten the length of the drawstring so that the exposed length was considerably reduced and so the added ornaments would have greater impact to the overall design, the user would have difficulty attaching the ornaments since the exposed length of the drawstring would be too short to provide suitable attachment structure.

Additionally, if the drawstring of a hoodie was made too short and decorations were added to the exposed ends, the head opening of the hoodie could end up being constricted and could be difficult for the wearer to adorn or remove the garment, that is without removing one or both of the ornaments.

Finally, when the particular hoodie, in this example, were to be washed, the decorations would have to be removed to avoid damage to them during the washing and drying process, or to avoid damaging the washing and drying machines. In such instance, if the hoodie drawstrings were cut to a desired shortened decorative length, and the decorations removed, the drawstring ends would likely recede into the fabric channel of the hoodie, and the drawstring ends would also likely be difficult to withdraw back out of the fabric channel once the hoodie was clean and the decorations ready to be reattached.

Accordingly, it is a first object of the present disclosure to provide drawstring systems that can easily selectively attach ornamentation, and which overcomes the deficiencies of the prior art.

It is another object of the present disclosure to provide drawstring systems with a draw string whose length can be easily adjusted so that the user that can easily add desired ornaments and also adjusted appropriately for washing of the garment. It is further another object of the present disclosure to provide drawstring systems where the open ends of the drawstrings include a combination of male and female fasteners that can be selectively coupled to one another such that the two open ends of the drawstrings are secured to one another. By coupling the male and female fasteners of the open ends together, the two drawstrings form a closed loop and the two drawstrings remain connected to the garment during storage or washing—this prevents drawstrings from being removed from the garment and/or prevents the open ends of the drawstrings from retreating into the drawstring channel of the garment.

It is another object of the present disclosure to provide drawstring systems with a drawstring onto which desired ornaments can be properly and securely attached.

It is yet another object of the present disclosure to provide drawstring systems with a drawstring which allows the fasteners of the attached ornaments and the entire ends of the drawstring to be concealed within the drawstring channel so that only the decorative elements remain in view, adjacent to the wearer's garment.

The features of the various embodiments of the present disclosure, and the manner of attaining them, will become more apparent and the various embodiments will be better understood by reference to the following description taken in conjunction with the accompanying drawings.

BRIEF DESCRIPTION OF THE DRAWINGS

The following detailed description of aspects of the disclosure will be better understood when read in conjunction with the appended drawings. It should be understood, however, that the disclosure is not limited to the precise arrangements and instrumentalities shown. In the drawings.

DETAILED DESCRIPTION OF THE PREFERRED EMBODIMENTS

Figure 1:
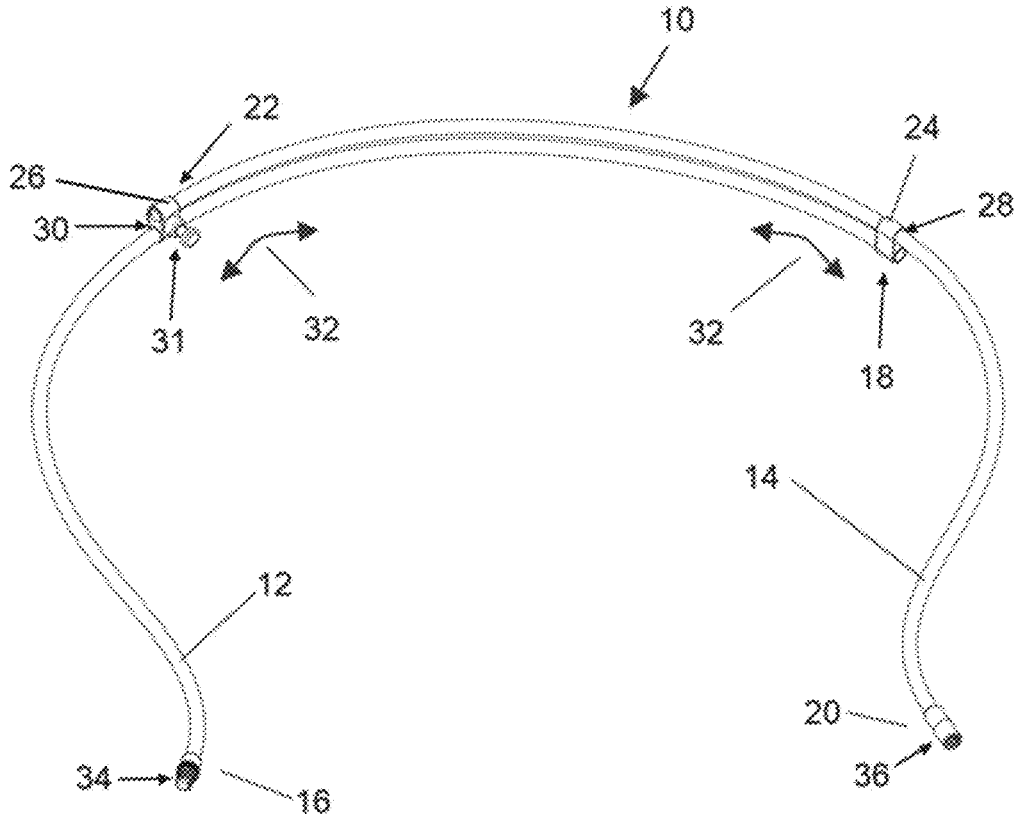
FIG. 1 is a perspective assembly view of an adjustable drawstring system, according to an embodiment of the disclosure, showing a first flexible elongated member having a first securing end and a first resistive element, a second flexible elongated member having a second securing end, and a second resistive element, the adjustable drawstring system shown in a curved orientation.

For the purposes of promoting an understanding of the principles of the present disclosure and presenting its currently understood best mode of operation, reference will now be made to the embodiments illustrated in the drawings and specific language will be used to describe the same. It will nevertheless be understood that no limitation of the scope of the present disclosure is thereby intended, with such alterations and further modifications in the illustrated device and such further applications of the principles of the present disclosure as illustrated therein being contemplated as would normally occur to one skilled in the art to which the present disclosure relates. It should also be understood that the phraseology and terminology employed herein are merely for descriptive purposes and should not be considered limiting.

It should further be understood that any one of the described features and embodiments may be used separately or in combination with other features and embodiments. Other inventive devices, systems, methods, features, and advantages will be or become apparent to one with skill in the art upon examining the drawings and the detailed description herein. It is intended that all such additional devices, systems, methods, features, and advantages be protected by the accompanying claims.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the liquid transfer device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

As used herein, the term "about" when used in connection with a referenced numeric indication means the referenced numeric indication plus or minus up to 10 percent of that referenced numeric indication. For example, "about 100" means from 90 to 110.

In a similar manner, the term "substantially" when used in connection with, for example, a geometric relationship, a numerical value, and/or a range is intended to convey that the geometric relationship (or the structures described thereby), the number, and/or the range so defined is nominally the recited geometric relationship, number, and/or range. For example, two structures described herein as being "substantially parallel" is intended to convey that, although a parallel geometric relationship is desirable, some non-parallelism can occur in a "substantially parallel" arrangement. By way of another example, a structure defining a volume that is "substantially 1 millimeter (mm) in height" is intended to convey that, while the recited height is desirable, some tolerances can occur when the measurement of the height is "substantially" the recited height (e.g., 1 mm). Such tolerances can result from manufacturing tolerances, measurement tolerances, and/or other practical considerations (such as, for example, minute imperfections, age of a structure so defined, a pressure or a force exerted within a system, and/or the like). As described above, a suitable tolerance can be, for example, ±10% of the stated geometric construction, numerical value, and/or range. Furthermore, although a numerical value modified by the term "substantially" can allow for and/or otherwise encompass a tolerance of the stated numerical value, it is not intend to exclude the exact numerical value stated.

As an overview, the present invention is essentially a drawstring system 10 that is meant to be installed within a garment or fashion item, such as around the rim of a hood of a hooded sweatshirt (i.e., a "hoodie"), the waist section of a pair of sweatpants, or any other garment that requires a drawstring to force a portion of the garment to cinch down around a portion of the wearer's body, or close off an otherwise open portion of the garment, such as a hood, shoe opening, or bag opening, albeit in a controlled manner. the adjustable drawstring system 10 can replace an ordinary drawstring that came with the particular already-purchased garment, or the drawstring system can be installed as an OEM drawstring during the production of a new garment. According to the present disclosure, the adjustable drawstring system 10 is adorned, or selectively adornable with easily removable ornaments and/or decorations and has a length that is either adjustable, or is precut to a set length so that only the adornments can be seen when attached to an installed drawstring. The length of the drawstring is such that no portion of the drawstring extends outside the garment (e.g., outside of the drawstring channel), while the garment is being worn. As described in greater detail below, the effective length of drawstring of the adjustable drawstring system 10 is an important feature of the present disclosure.

Figure 2:
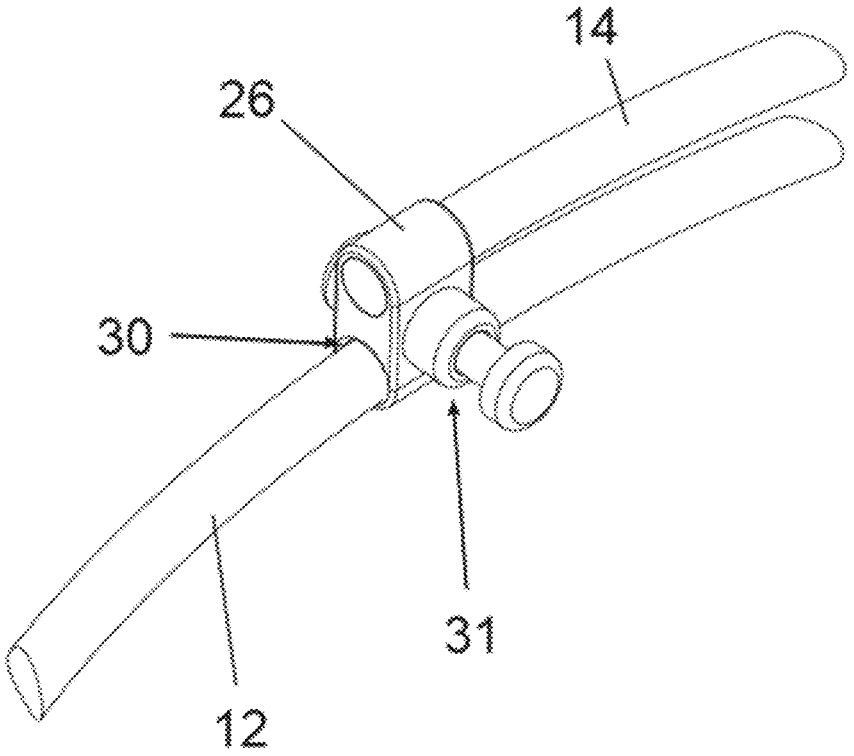
FIG. 2 is an enlarged perspective assembly view of the adjustable drawstring system of FIG. 1, showing details of a push-button friction lock, according to an embodiment of the present disclosure.

Referring to FIGS. 1 and 2, an adjustable drawstring system 10, according to an embodiment of the present disclosure, is shown, including a first flexible elongated member 12 and a second flexible elongated member 14. In some embodiments, the first and second elongated members 12, 14 are in the form of a cord. The first flexible elongated member 12 defines an open end 16 (free end) and a sliding end 18. Similarly, the second flexible elongated member 14 defines an open end 20 (free end) and a sliding end 22. A first sliding element 24 is secured to the sliding end 18 of the first flexible elongated member 12. In some embodiments, the sliding end 18 of the first flexible elongated member 12 is fixed to the first sliding element 24 by one or more of sewing, crimping, tacking, welding and/or fusing. The first sliding element 24 includes a bore 28 that is configured to slidingly receive a portion of second flexible elongated member 14 (between the open end 20 and the sliding end 22).

A second sliding element 26 is secured to the sliding end 22 of the second flexible elongated member 14. In some embodiments, the sliding end 22 of the second flexible elongated member 14 is fixed to the second sliding element 26 by one or more of sewing, crimping, tacking, welding and/or fusing. The second sliding element 26 includes a bore 30 that is configured to slidingly receive a portion of the first flexible elongated member 12 (between the open end 16 and the sliding end 18). Although the bores 28 and 30 or first and second sliding elements 24, 26, respectively, are configured to receive flexible elongated members 12, 14 so that they may slide within their respective bores, 28, 30, in some embodiments, the relative size of each of the bores 28, 30, and the relative size and sectional shape of the flexible elongated members 12, 14 can be selected such that a controlled amount of friction is created between respective the sliding elements 24, 26 and the flexible elongated members 12, 14. The flexible elongated members 12, 14 should be able to slide within the bores 28, 30 of the sliding elements 24, 26, but preferably against a predetermined amount of friction so that the sliding elements stay in place when at rest and no pulling forces are applied on the flexible elongated members 12, 14. In some embodiments, the bores 28, 30 may each define a first cross-sectional area, a length of each of the first and second flexible elongated members 12, 14 may define a second cross-sectional area, and the second cross-sectional area is greater than or equal to the first cross-sectional area. In some embodiments, the second cross-sectional area is greater than the first cross-sectional area to provide kinetic frictional resistance while a user pulls the length of the first flexible elongated member 12 through the bore 30, or while the user pulls the length of the second flexible elongated member 14 through the bore 28.

In some embodiments, at least one of the sliding element 24, 26 includes a selectively activatable lock 31 that introduces selective very high friction to the adjacent first flexible elongated member 12, 14, thereby locking both flexible elongated members relative to each other, and so that the lock 31 must be released manually by the user (pushing a button, for example) in order to allow the adjacent flexible elongated member to slide relatively to the sliding element. In some embodiments, the selectively activatable lock 31 includes an engagement surface for selectively engaging a surface of the length of the first flexible elongated member 12 to prevent movement of the length of the second flexible elongated member 12 relative to the second sliding element 26. In some embodiments, a selectively activatable lock (not shown) includes an engagement surface for selectively engaging a surface of the length of the second flexible elongated member 14 to prevent movement of the length of the second flexible elongated member 14 relative to the first sliding element 24.

This arrangement effectively secures the relative positions of the first flexible elongated member 12 and the second flexible elongated member 14 together, in a controlled sliding manner, after the effective length of the combined flexible elongated members 12, 14 have been adjusted by sliding the two sliding elements 24, 26, against the predetermined amount of friction (and by releasing the lock 31, if one is used), towards or away from each other, as represented by arrows 32 in FIGS. 1 and 2. The end result is that a user can quickly and easily adjust the effective length and distance between the open ends 16, 20 of the flexible elongated members 12, 14, as measured along a straightened length of the combined flexible elongated members 12, 14. To shorten the effective length of the combined flexible elongated members 12, 14 of the adjustable drawstring system 10, the user can grab each sliding element 24, 26 (and release the friction lock, if one is used), and pull them away from each other. This will cause the first flexible elongated member 12 to overlap a greater distance with respect to the second flexible elongated member 14, and will therefore draw the two open ends, 16 and 20 closer together. Similarly, the user can lengthen the adjustable drawstring system 10 by simply pulling each open end 16, 20 away from each other. This action will cause sliding element 24 of first flexible elongated member 12 to slide along second flexible elongated member 14 and simultaneously, cause sliding element 26 of second flexible elongated member 14 to slide along first flexible elongated member 12. The two sliding elements 24, 26 will advance towards each other and cause the open ends 16, 20 to move away from each other.

In some embodiments, the lock 31 is a friction lock. In some embodiments, the lock 31 is spring-loaded and includes an internal bore that expands when a button of the lock is depressed, and the internal bore of the lock 31 contracts when the button of the lock is released such that the lock 31 selectively engages with an outer surface of the first flexible elongated member 12. In some embodiments, the lock 31 includes a threaded knob with a distal end that selectively grips the outer surface of the first flexible elongated member 12. Although the lock 31 is shown as being provided on the second sliding element 26 and is operable to selectively engage the outer surface of the first flexible elongated member 12, it will be appreciated by one skilled in the art in view of the present disclosure that a lock can be additionally or alternatively provided on the first sliding element 24.

The functional relationship of the slidingly-connected flexible elongated members 12, 14 that make up the adjustable drawstring system 10 have been thus described with the two flexible elongated members 12, 14. This was done for clarity in explaining the adjustment mechanism. When installed within a garment, the adjustable drawstring system 10 will be inserted into an opening (such as opening 54 of FIGS. 9-11) in the garment, guided by a drawstring channel to form a generally U-shaped or O-shaped loop shape, extending around an opening of the garment, such as around the head opening (the base of a hood) in a hooded sweatshirt, or around the waist opening of a pair of sweatpants. This loop shape is illustrated (without the garment) in FIG. 1. In some embodiments, the effective length of the first flexible elongated member 12 and the second flexible elongated member 14, measured from the first open end 16 to the second open end 20, may be adjusted to provide a desired exposed length outside the garment, and then installed into the garment, such as around the rim of a hood in a hoodie, or around the waist of a pair of sweatpants. The desired adjustment will vary depending on the size and type of the garment, as well as the location of the drawstring. Regardless, it is desired, according to embodiment of the present disclosure, that the effective length of the first flexible elongated member 12 and the second flexible elongated member 14 be adjustable such that open ends 16, 20 can remain inside the garment, about an inch (or about 2.5 centimeters) from the opening 54 (see FIG. 13). This distance will allow ornaments to be attached to the open ends of the drawstring without the fasteners or the ends of the first and second flexible elongated members 12, 14 being in view from outside the garment, and permit only the ornaments being exposed.

In the case where the adjustable drawstring system 10 of the present disclosure is provided as an OEM drawstring, to be installed into new garments at the factory, the flexible elongated members 12, 14 can be pre-cut to a length that ensures that the flexible elongated members 12, 14 of the adjustable drawstring system 10 can be adjusted so they remain entirely within the garment, with open ends 16 and 20 being located about 1 inch (or about 2.5 centimeters) from the opening. The length of the drawstring will vary depending on the size and type of the garment, as well as the location of the drawstring.

As shown in FIGS. 1 and 3-6, the open end 16 of the first flexible elongated member 12 may include a male mechanical fastener 34, 34A, 34B, 34C. Similarly, the open end 20 of the second flexible elongated member 14 may include a female mechanical fastener 36, 36A, 36B, 36C. The purpose of male mechanical fastener 34, 34A, 34B, 34C is to receive a decorative element 38, 38A (see e.g., FIGS. 7-8 and 10-11), which is coupled to a female mechanical fastener 36, 36A, 36B, 36C. The male mechanical fastener 34, 34A, 34B, 34C is configured to matingly and mechanically engage with a corresponding female mechanical fastener 36, 36A, 36B, 36C, 36D, when desired, so that a user can easily attached and detach a desired decorative element 38 to the open end 16 of the first flexible elongated member 12.

Similarly, the purpose of female mechanical fastener 36, 36A, 36B, 36C is to receive a decorative element 42, 42A which includes a male mechanical fastener 34, 34A, 34B, 34C. Female mechanical fastener 36, 36A, 36B, 36C is configured to matingly and mechanically engage with male mechanical fastener 34, 34A, 34B, 34C, when desired, so that a user can easily attached and detach a desired decorative element 42, 42A to the open end 20 of the second flexible elongated member 14. Although the open end 16 of the first flexible elongated member 12 is shown as being provided with a male mechanical fastener 34, 34A, 34B, 34C, and the open end 20 of the second flexible elongated member 14 is shown as being provided with a female mechanical fastener 36, 36A, 36B, 36C, it will be appreciated by one skilled in the art in view of the present disclosure that the male/female arrangement between the two flexible elongated members 12, 14 can be reversed, or that both flexible elongated members 12, 14 may be provided with same male/female mechanical fastener (with the decorative elements being provided with the opposite male/female mechanical fastener).

Also, in some embodiments, in addition to the male mechanical fastener 34 selectively receiving the decorative element 38, and the female mechanical fastener 36 selectively receiving the decorative element 42, the male mechanical fastener 34 is also configured to selectively receive the female mechanical fastener 36. In other words, the open ends 16, 20 of the adjustable drawstring system 10, according to the present disclosure, can either receive decorations, or be connected to each other, without decorations. This allows a user to remove decorative elements 38, 42 from open ends 16, 20, and then connect the open ends of the drawstring to each other to form a closed loop. By forming a closed loop, the adjustable drawstring system 10 can be easily secured to the garment for storage or during washing so that the drawstring remains connected to the garment. The decorations are removed since they could become damaged during washing.

In some embodiments, a single decorative element may be provided with a female mechanical fastener on a first end to selectively attach to the open end 16 of the first flexible elongated member 12 and provided with a male mechanical fastener on a second end to selectively attach to the open end 20 of the second flexible elongated member 14 such that the combination the first flexible elongated member 12, the second flexible elongated member 14, and the single decorative element can form a closed loop to provide a necklace-like appearance. In this configuration, the open ends 16, 20 may be hidden within the drawstring channel of the garment, while the single decorative element hangs visibly like a necklace.

Figure 3:
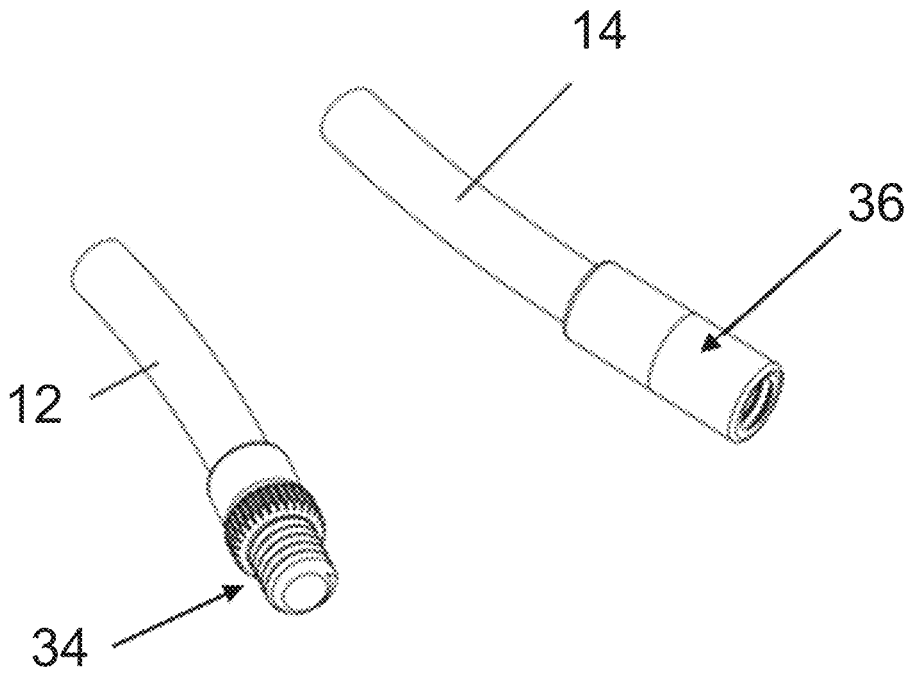
FIG. 3 is an enlarged perspective view of a threaded screw-type mechanism with first and second securing ends for use with an adjustable drawstring system such as the one shown in FIG. 1, according to an embodiment of the present disclosure.

Referring to FIGS. 3-6, different types of mechanical fasteners and coupling mechanisms are shown that may be used with the adjustable drawstring system 10, or any other adjustable drawstring system described herein. FIG. 3 shows a male mechanical fastener 34 with external screw threads and a female mechanical fastener 36 with internal screw threads configured to receive and engage with the external screw threads of the male mechanical fastener.

Figure 4:
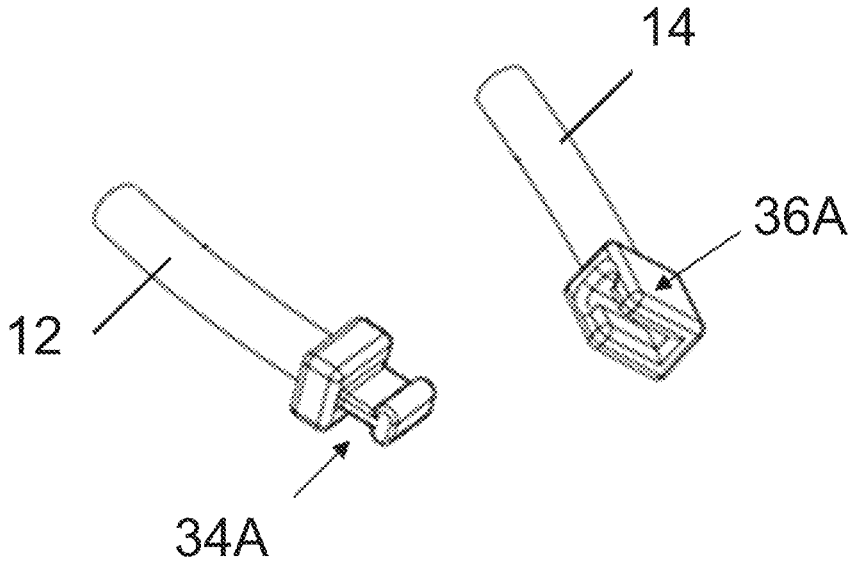
FIG. 4 is an enlarged perspective view of a slide-connection-type coupling mechanism with first and second securing ends for use with an adjustable drawstring system such as the one shown in FIG. 1, according to an embodiment of the present disclosure.

FIG. 4 shows a male mechanical fastener 34A with a T-shaped protrusion and a female mechanical fastener 36A with a T-shaped recess or channel configured to receive and engage with the T-shaped protrusion of the male mechanical fastener 34A.

Figure 5:
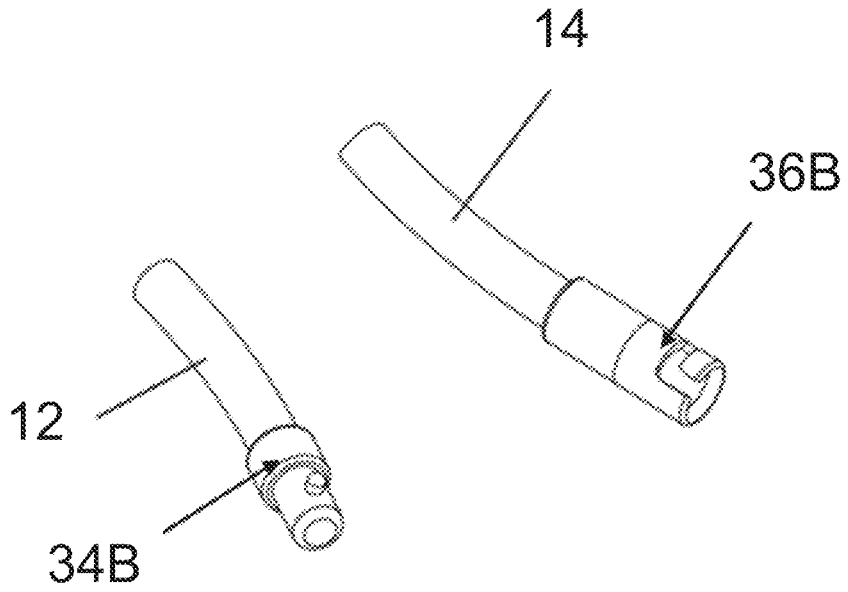
FIG. 5 is an enlarged perspective view of a bayonet-type coupling mechanism with first and second securing for use with an adjustable drawstring system such as the one shown in FIG. 1, according to an embodiment of the present disclosure.

FIG. 5 shows a male mechanical fastener 34B with a cylindrical body and a post extending laterally from the cylindrical body and a female mechanical fastener 36B with a cylindrical cavity with an associate a guide channel (e.g., bayonet-type coupling) for receiving the post to prevent axial movement between the male mechanical fastener 34B and the female mechanical fastener 36B once the post is fully engaged with the guide channel.

Figure 6:
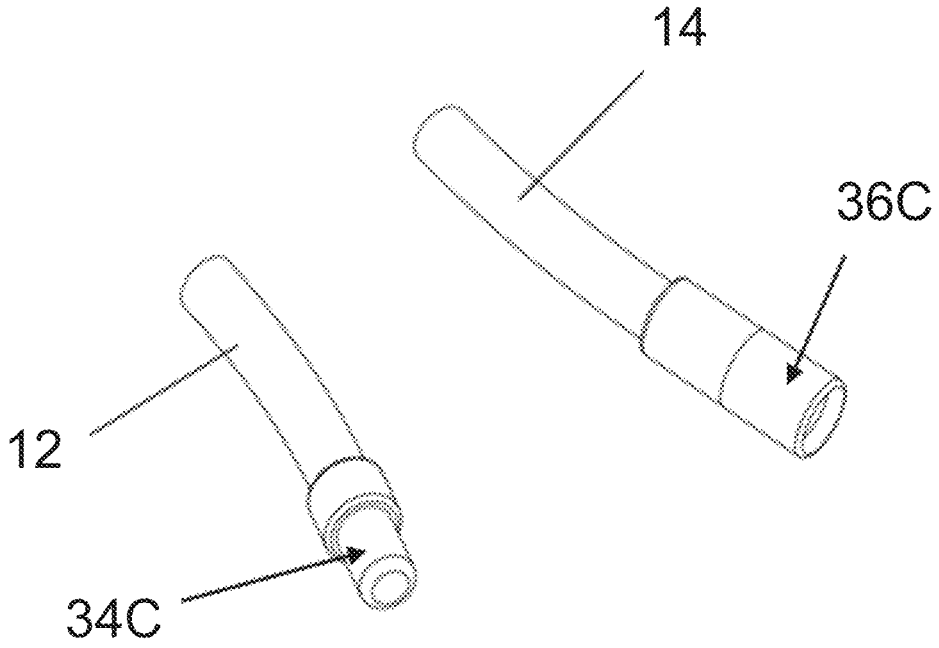
FIG. 6 is an enlarged perspective view of a magnetic-type coupling mechanism with first and second securing ends for use with an adjustable drawstring system such as the one shown in FIG. 1, according to an embodiment of the present disclosure.

FIG. 6 shows a male mechanical fastener 34C with a cylindrical body and a female mechanical fastener 36C with a cylindrical cavity to receive and engage with the cylindrical protrusion of the male mechanical fastener 34C. The male mechanical fastener 34C and the female mechanical fastener 36C are further provided with magnets of opposite polarity that resists prevent axial movement between the male mechanical fastener 34C and the female mechanical fastener 36C. In some embodiments, the strength of the magnets for the male and female mechanical fasteners 34C, 36C may be adjusted to require an intentional and significant force to be applied by the user to separate the male and female mechanical fasteners 34C, 36C. In some embodiments, the male and female mechanical fasteners may mechanically be inserted and engage in a lateral direction (similar to the arrangement of FIG. 4) and magnets of opposite polarity may be arranged to resist separation in the lateral direction. The lateral mechanical and magnetic coupling arrangement may enable axial forces to be applied to the male and female mechanical fasteners (e.g., to adjust a position of the flexible elongated member or drawstring without accidentally or inadvertently decoupling the male and female mechanical fasteners in the process. It will be understood by one skilled in the art that any of the mechanical fasteners described herein may be provided with magnets of opposite polarity to desist decoupling during use. Additionally, it will be understood by one skilled in the art that any of the mechanical fasteners herein may be dimensioned and/or made with materials to provide sufficient frictional force to keep the mechanical fasteners engaged absent an intentional force being applied by a user to separate the mechanical fasteners.

In some embodiments, the male mechanical fasteners 34, 34A, 34B, 34C includes a proximal end that is configured to couple to an open end of a first flexible elongated member, such as the first flexible elongated member 12. In some embodiments, the female mechanical fasteners 36, 36A, 36B, 36C includes a proximal end that is configured to couple to an open end of a second flexible elongated member, such as the second flexible elongated member 14.

In some embodiments, the male mechanical fasteners 34, 34A, 34B, 34C that are attached to the first flexible elongated member 12 are operable to removably secure to a respective female mechanical fasteners (similar to the female mechanical fasteners 36, 36A, 36B, 36C) that is in turn attached to a decorative element. In some embodiments, the female mechanical fasteners 36, 36A, 36B, 36C that are attached to the second flexible elongated member 14 are operable to removably secure to a respective male mechanical fasteners (similar to the male mechanical fasteners 34, 34A, 34B, 34C) that is in turn attached to a decorative element.

In some embodiments, the male mechanical fasteners 34, 34A, 34B, 34C that are attached to the first flexible elongated member 12 are operable to removably secure to the female mechanical fasteners 36, 36A, 36B, 36C secured to the second flexible elongated member 14 in order for the adjustable drawstring system 10 to form a closed loop. This may be advantageous when washing a garment with the adjustable drawstring system 10 installed to prevent one of the ends of the adjustable drawstring system 10 from retreating into the drawstring channel during the washing process. In some embodiments, the attachment of the male mechanical fasteners 34, 34A, 34B, 34C to the female mechanical fasteners 36, 36A, 36B, 36C in order to form a closed loop may be preceded by a step of adjusting an effective length (e.g., lengthening or shortening) of the first flexible elongated member 12 and the second flexible elongated member 14. In some embodiments, the attachment of the male mechanical fasteners 34, 34A, 34B, 34C to the female mechanical fasteners 36, 36A, 36B, 36C in order to form a closed loop is not preceded by any adjustment of length of the first flexible elongated member 12 and the second flexible elongated member 14 (e.g., the effective length is kept the same). When the effective length of the first flexible elongated member 12 and the second flexible elongated member 14 is kept the same, particularly when the effective length of the first flexible elongated member 12 and the second flexible elongated member 14 is shorter than the entire length of the drawstring channel, one or more of the first flexible elongated member 12 and the second flexible elongated member 14 may be cinched to expose the open ends 16, 20 outside of the drawstring channel. Once the open ends 16, 20 with the male and the female mechanical fasteners 34, 34A, 34B, 34C, 36, 36A, 36B, 36C are exposed, they may be attached together to form the closed loop. It will be understood by one skilled in the art that after washing or storage, the mechanical fasteners may be detached from one another and decorative elements may be reattached using the systems and methods described herein.

The above mechanical fasteners may be used with the adjustable drawstring systems of the present disclosure and are not meant to restrict the scope of usable fasteners. It will be understood by one skilled in the art that other types of fasteners can be used, including but not limited to snap fasteners, hook and loop fasteners, and buckles, as long as the decorative element 38, 42 can be easily and securely attached to either male mechanical fasteners, or female mechanical fasteners, and as long as open ends 16, 20 can be also selectively connected to each other to form a loop when desired. Each type of fastener mechanism shown in FIGS. 3-6 would receive mating type fasteners attached to ornaments or decorative elements 38, 42 so that the ornaments could be selectively attached to the open ends 16, 20 of the adjustable drawstring system 10, as described above.

In some embodiments, any of the decorative elements and/or any of the mechanical fasteners described herein may further include a swivel connection such that the corresponding decorative element may be rotated relative to the fastening mechanism without twisting the open ends 16, 20 of the flexible elongated members 12, 14. For example, in the threaded type fastener shown in FIG. 3, according to an embodiment of the present disclosure, it may be desired that either the male or the female portion include a swivel connection so that the threads may engage with each other without forming a twist in the drawstring during tightening. This prevents the open ends 16, 20 from twisting and/or enables the decorative element to remain facing in a particular orientation during coupling of the fastening mechanism. For example, the decorative element may include a logo, emblem, word, or phrase with a forward or outwardly facing orientation, and the swivel connection permits the logo, emblem, word, or phrase to be displayed properly without twisting of the drawstring or flexible elongated member.

Figure 7:
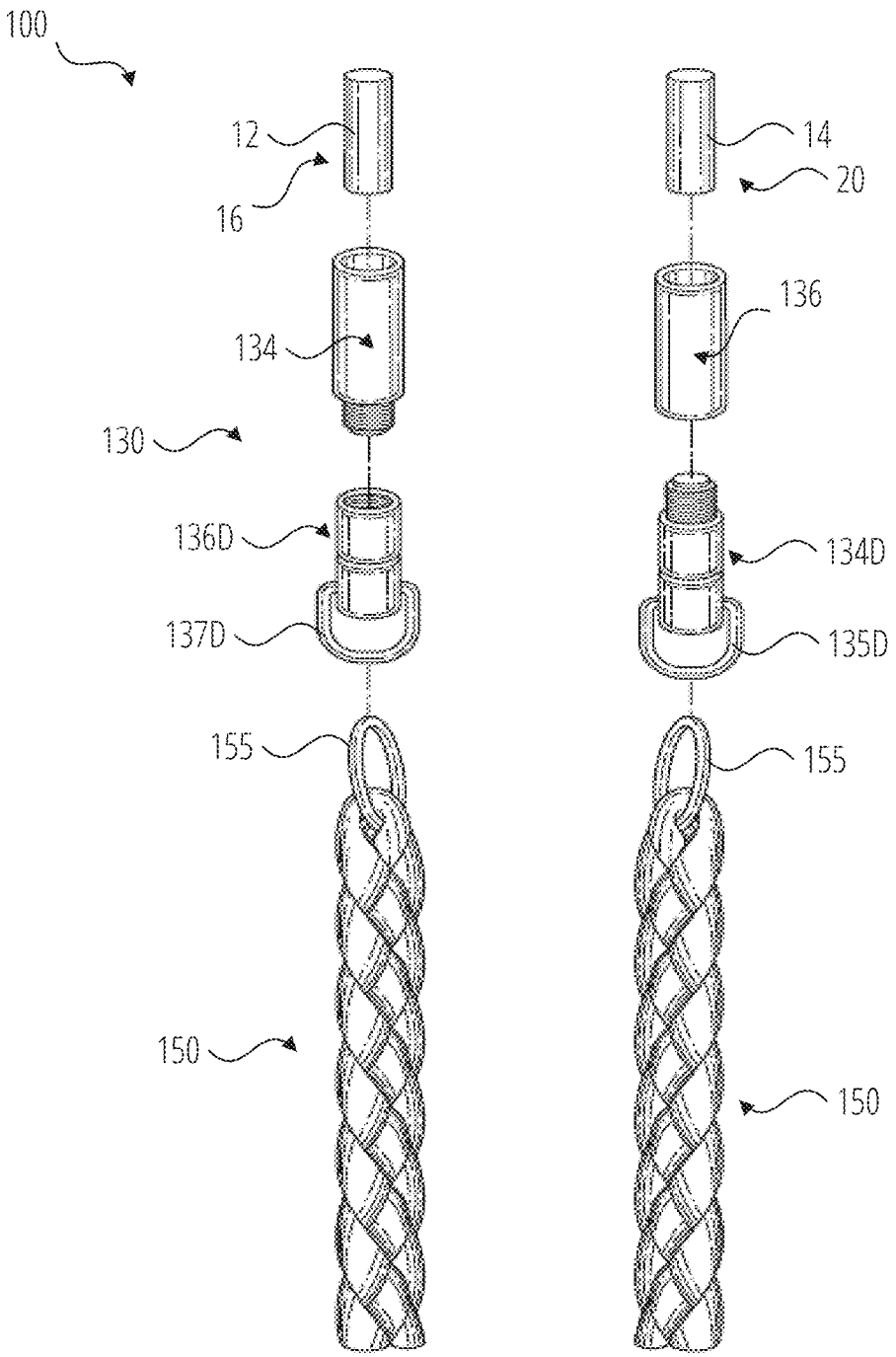
FIG. 7 is an enlarged perspective view of a kit including a set of threaded screw-type mechanisms with a D-shaped ring for decorative attachments and a set of decorative attachments for mounting onto the D-shaped ring, according to an embodiment of the present disclosure.

FIG. 7 shows a perspective view of a kit 100 including a fastener system 130 and decorative elements 150 that can be used with any of the adjustable drawstring systems described herein, including but not limited to, the adjustable drawstring system 10. The mechanical fastener system 130 includes a first male mechanical fastener 134, a first female mechanical fastener 136, a second male mechanical fastener 134D, and a second female mechanical fastener 136D. It is noted that while the decorative elements 150 are shown as being a braided decorative element, it will be understood by one skilled in the art in view of the present disclosure that any form of decorative element may be attached to the adjustable drawstring system using the fastener system 130. For example, the decorative element may include one or more of beads, embroidery, printed patterns, colored tips (aglets), various charms, and custom braiding. The decorative element may include a logo, emblem, word, or phrase. The decorative element may be made of one or more materials such as glass beads, gemstones, leather pieces, wood, precious metals, pom-poms, fabric, sequins, various ornaments made from knotted cords, and others.

The first male mechanical fastener 134 includes a proximal end portion and a distal end portion opposite from the proximal end portion of the first male mechanical fastener 134. The proximal end portion of the first male mechanical fastener 134 (e.g., upper end portion of the first male mechanical fastener 134 as shown in FIG. 7) includes an opening and a cavity for receiving an end of a drawstring or a flexible elongated member, such as the open end 16 of the first flexible elongated member 12. The distal end portion of the first male mechanical fastener 134 (e.g., bottom end portion of the first male mechanical fastener 134 as shown in FIG. 7) includes a male mating element. In some embodiments, the male mating element includes external screw threads and is configured to engage with internal screw threads of one of the first or second female mechanical fasteners 136, 136D.

The first female mechanical fastener 136 includes a proximal end portion and a distal end portion opposite from the proximal end portion of the first female mechanical fastener 136. The proximal end portion of the first female mechanical fastener 136 (e.g., upper end portion of the first female mechanical fastener 136 as shown in FIG. 7) includes an opening and a cavity for receiving an end of a drawstring or a flexible elongated member, such as the open end 20 of the second flexible elongated member 14. The distal end portion of the second male mechanical fastener 136 (e.g., lower end portion of the first female mechanical fastener 136 as shown in FIG. 7) includes a female mating element. In some embodiments, the female mating element includes internal screw threads and is configured to engage with external screw threads of one of the first or second male mechanical fasteners 134, 134D.

The second male mechanical fastener 134D includes a proximal end portion and a distal end portion opposite from the proximal end portion of the second male mechanical fastener 134D. The proximal end portion of the second male mechanical fastener 134D (e.g., upper end portion of the second male mechanical fastener 134D as shown in FIG. 7) includes a male mating element. In some embodiments, the male mating element includes external screw threads and is configured to engage with internal screw threads of the first female mechanical fastener 136. The distal end portion of the second male mechanical fastener 134D (e.g., bottom end portion of the second male mechanical fastener 134D as shown in FIG. 7) includes an attachment structure 135D configured to receive and/or attached to a decorative element 150, as will be described in greater detail below. In some embodiments, the attachment structure 135D is a D-ring that is removably mountable onto the distal end portion of the second male mechanical fastener 134D. For example, the side surfaces of the distal end portion of the second male mechanical fastener 134D may include two openings or detents for receiving the legs of the D-ring.

In some embodiments, the distal end portion of the second male mechanical fastener 134D may include an opening and a cavity (similar to the proximal end portion of the first male mechanical fastener 134), which may be used to assist in the removal of the legs of the D-ring (if desired by the user), or the opening and cavity may be used to receive and secure an end of a decorative element 150. In some embodiments, the openings on the side surfaces of the distal end portion of the second male mechanical fastener 134D may be configured to receive a set screw or bolt in order to secure an end of the decorative element 150 to the distal end portion of the second male mechanical fastener 134D. In some embodiments, the proximal and distal end portions of the second male mechanical fastener 134D are two separate components (see boundary line between the proximal and distal end portions) that are rotatable relative to one another to provide a swivel connection described above. In some embodiments, the decorative element 150 may include a latch or ring 155 for engaging with or securing around the D-ring.

The second female mechanical fastener 136D includes a proximal end portion and a distal end portion opposite from the proximal end portion of the second female mechanical fastener 136D. The proximal end portion of the second female mechanical fastener 136D (e.g., upper end portion of the second female mechanical fastener 136D as shown in FIG. 7) includes a female mating element. In some embodiments, the female mating element includes internal screw threads and is configured to engage with external screw threads of the first male mechanical fastener 134. The distal end portion of the second female mechanical fastener 136D (e.g., bottom end portion of the second female mechanical fastener 136D as shown in FIG. 7) includes an attachment structure 137D configured to receive and/or attached to a decorative element 150. In some embodiments, the attachment structure 137D is a D-ring that is removably mountable onto the distal end portion of the second female mechanical fastener 136D. For example, the side surfaces of the distal end portion of the second female mechanical fastener 136D may include two openings or detents for receiving the legs of the D-ring.

In some embodiments, the distal end portion of the second female mechanical fastener 136D may include an opening and a cavity (similar to the proximal end portion of the first female mechanical fastener 136), which may be used to assist in the removal of the legs of the D-ring (if desired by the user), or the opening and cavity may be used to receive and secure an end of the decorative element 150. In some embodiments, the openings on the side surfaces of the distal end portion of the second female mechanical fastener 136D may be configured to receive a set screw or bolt in order to secure an end of the decorative element to the distal end portion of the second female mechanical fastener 136D. In some embodiments, the proximal and distal end portions of the female mechanical fastener 136D are two separate components (see boundary line between the proximal and distal end portions) that are rotatable relative to one another to provide a swivel connection described above.

Figure 8:
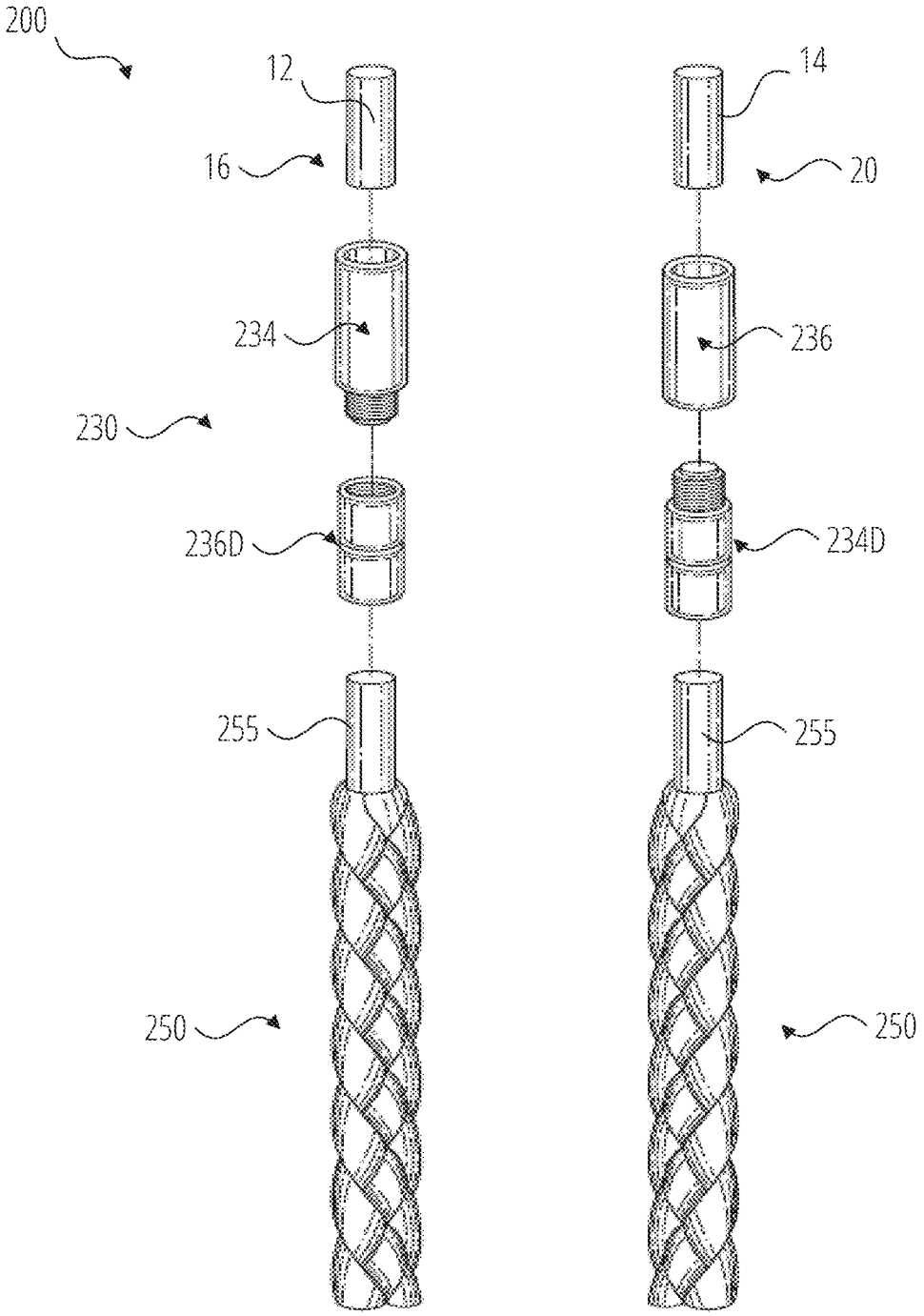
FIG. 8 is an enlarged perspective view of a kit including a set of threaded screw-type mechanisms with a slip insertion receiver for decorative attachments, and a set of decorative attachments for mounting to the slip insertion receiver according to an embodiment of the present disclosure.

FIG. 8 shows a perspective view of a kit 200 including a fastener system 230 and decorative elements 250 that can be used with any of the adjustable drawstring systems described herein, including but not limited to, the adjustable drawstring system 10. The mechanical fastener system 230 includes a first male mechanical fastener 234, a first female mechanical fastener 236, a second male mechanical fastener 234D, and a second female mechanical fastener 236D. It is noted that while the decorative elements 250 are shown as being a braided decorative element, it will be understood by one skilled in the art in view of the present disclosure that any form of decorative element may be attached to the adjustable drawstring system using the fastener system 230. For example, the decorative element may include one or more of beads, embroidery, printed patterns, colored tips (aglets), various charms, and custom braiding. The decorative element may include a logo, emblem, word, or phrase. The decorative element may be made of one or more materials such as glass beads, gemstones, leather pieces, wood, precious metals, pom-poms, fabric, sequins, various ornaments made from knotted cords, and others.

The first male mechanical fastener 234 includes a proximal end portion and a distal end portion opposite from the proximal end portion of the first male mechanical fastener 234. The proximal end portion of the first male mechanical fastener 234 (e.g., upper end portion of the first male mechanical fastener 234 as shown in FIG. 8) includes an opening and a cavity for receiving an end of a drawstring or a flexible elongated member, such as the open end 16 of the first flexible elongated member 12. The distal end portion of the first male mechanical fastener 234 (e.g., bottom end portion of the first male mechanical fastener 134 as shown in FIG. 8) includes a male mating element. In some embodiments, the male mating element includes external screw threads and is configured to engage with internal screw threads of one of the first or second female mechanical fasteners 236, 236D.

The first female mechanical fastener 236 includes a proximal end portion and a distal end portion opposite from the proximal end portion of the first female mechanical fastener 236. The proximal end portion of the first female mechanical fastener 236 (e.g., upper end portion of the first female mechanical fastener 236 as shown in FIG. 8) includes an opening and a cavity for receiving an end of a drawstring or a flexible elongated member, such as the open end 20 of the second flexible elongated member 14. The distal end portion of the second male mechanical fastener 236 (e.g., lower end portion of the first female mechanical fastener 236 as shown in FIG. 8) includes a female mating element. In some embodiments, the female mating element includes internal screw threads and is configured to engage with external screw threads of one of the first or second male mechanical fasteners 234, 234D.

The second male mechanical fastener 234D includes a proximal end portion and a distal end portion opposite from the proximal end portion of the second male mechanical fastener 134D. The proximal end portion of the second male mechanical fastener 234D (e.g., upper end portion of the second male mechanical fastener 234D as shown in FIG. 8) includes a male mating element. In some embodiments, the male mating element includes external screw threads and is configured to engage with internal screw threads of the first female mechanical fastener 236. The distal end portion of the second male mechanical fastener 134D (e.g., bottom end portion of the second male mechanical fastener 134D as shown in FIG. 8) includes an opening and a cavity for receiving an end or an insertion portion 255 of the decorative elements 250. In some embodiments, the insertion portion 255 of the decorative elements 250 may be sewn, crimped, glued, tacked, welded, or fused with or in the cavity of the distal end portion of the second male mechanical fastener 134D. In some embodiments, the cavity of the distal end portion of the second male mechanical fastener 134D may include teeth or detents allowing the insertion portion 255 to be inserted into and secured to the second male mechanical fastener 134D, but prevents the insertion portion 255 from being removed from the cavity. n some embodiments, the kit 100 is provided with a tool and/or adhesive for securing the insertion portion 255 to the distal end portion of the second female mechanical fastener 136D.

In some embodiments, the proximal and distal end portions of the male mechanical fastener 134D are two separate components (see boundary line between the proximal and distal end portions) that are rotatable relative to one another to provide a swivel connection described above.

The second female mechanical fastener 236D includes a proximal end portion and a distal end portion opposite from the proximal end portion of the second female mechanical fastener 236D. The proximal end portion of the second female mechanical fastener 236D (e.g., upper end portion of the second female mechanical fastener 236D as shown in FIG. 8) includes a female mating element. In some embodiments, the female mating element includes internal screw threads and is configured to engage with external screw threads of the first male mechanical fastener 234.

The distal end portion of the second female mechanical fastener 136D (e.g., bottom end portion of the second female mechanical fastener 136D as shown in FIG. 8) includes an opening and a cavity for receiving an end or an insertion portion 255 of the decorative elements 250. In some embodiments, the insertion portion 255 of the decorative elements 250 may be sewn, crimped, glued, tacked, welded, or fused with or in the cavity of the distal end portion of the second female mechanical fastener 136D. In some embodiments, the cavity of the distal end portion of the second female mechanical fastener 236D may include teeth or detents allowing the insertion portion 255 to be inserted into and secured to the second female mechanical fastener 236D, but prevents the insertion portion 255 from being removed from the cavity. In some embodiments, the kit 200 is provided with a tool and/or adhesive (e.g., glue) for securing the insertion portion 255 to the distal end portion of the second female mechanical fastener 236D.

In some embodiments, the proximal and distal end portions of the female mechanical fastener 234D are two separate components (see boundary line between the proximal and distal end portions) that are rotatable relative to one another to provide a swivel connection described above.

Figure 9:
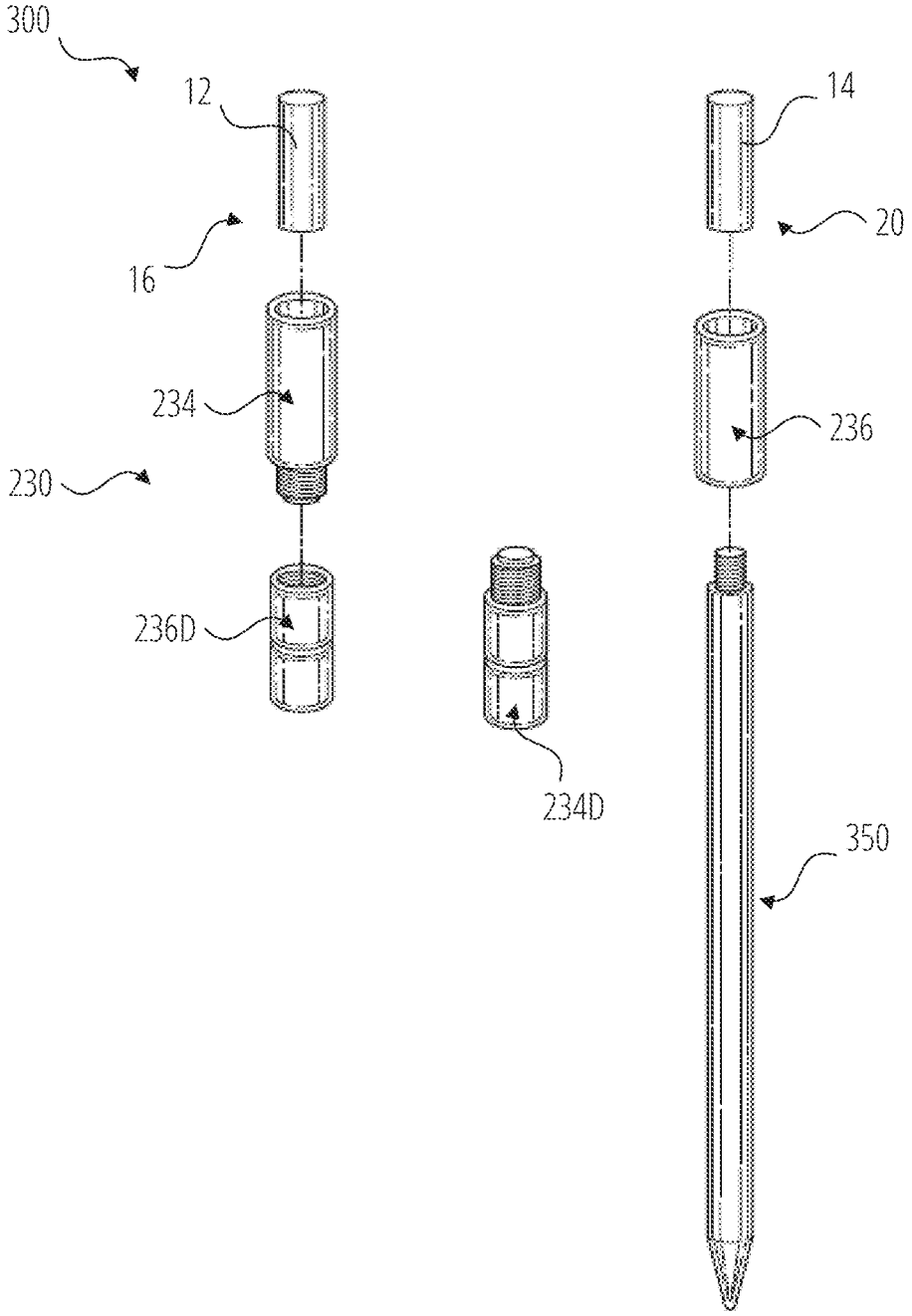
FIG. 9 is an enlarged perspective view of a kit including a set of threaded screw-type mechanisms with a slip insertion receiver for decorative attachments, and a drawstring channel guide tool with a threaded mounting end according to an embodiment of the present disclosure.

FIG. 9 shows a perspective view of a kit 300 including the fastener system 230. Although not shown, the kit 300 may further include one or more decorative elements 250 (or any other decorative elements disclosed herein). Although the decorative elements 250 of FIG. 8 are shown as being identical, in some embodiments, the decorative elements may be different from one another (e.g., non-symmetrical, different colors, different styles, different sizes, different appearance, different materials, etc.). In some embodiments, the kit 300 may include an insertion tool 350. The insertion tool 350 may include a proximal end portion and a distal end portion opposite from the proximal end portion. The proximal end portion of the insertion tool 350 may include external screw threads that is configured to engage with internal screw threads of the first female mechanical fastener 236. In other embodiments, the proximal end portion of the insertion tool 350 may include internal screw threads that is configured to engage with external screw threads of the first male mechanical fastener 234. As will be appreciated by one skilled in the art in view of the present disclosure, the insertion tool 350 may be removably attached to one of the first male or female mechanical fasteners 234, 236 (or any of the other male or female mechanical fasteners described herein) to facilitate threading of a drawstring cord or flexible elongated member through a drawstring channel.

The decorative elements described herein (which may also be referred to as ornaments), shown in the figures are illustrative examples to explain the structure and operation of the present disclosure. In some embodiments, decorative elements 38, 42 (see FIGS. 10 and 11). Of course, decorative elements 38, 42 can be any of many different types of decorations, made from many different types of materials, such as glass beads, gemstones, leather pieces, wood, precious metals, pom-poms, fabric, sequins, various ornaments made from knotted cords, and others. Regardless of the decorative elements, 38, 42, according to the disclosure, each decorative element includes either a male mechanical fastener 34, 34A, 34B, 34C, 134D, 234D or a female mechanical fastener 36, 36A, 36B, 36C, 136D, 236D as described above, so that the decorative elements 38, 42 can be selectively attached to the mating male mechanical fastener 34, 34A, 34B, 34C, 134, 234, or a female mechanical fastener 36, 36A, 36B, 36C, 136, 236 that is attached to a drawstring or a flexible elongated member of an adjustable drawstring system.

Figure 10:
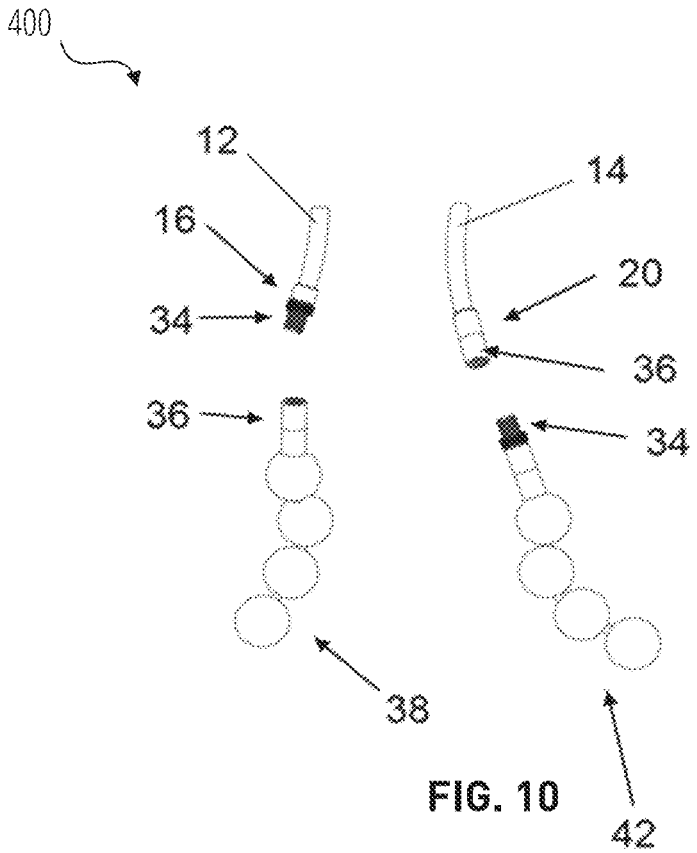
FIG. 10 is an enlarged perspective view of a screw type coupling mechanism with first and second securing ends for use with the adjustable drawstring system of FIG. 1, showing attachable first and second decorations mounted using the screw type coupling mechanism, according to an embodiment of the present disclosure.
Figure 11:
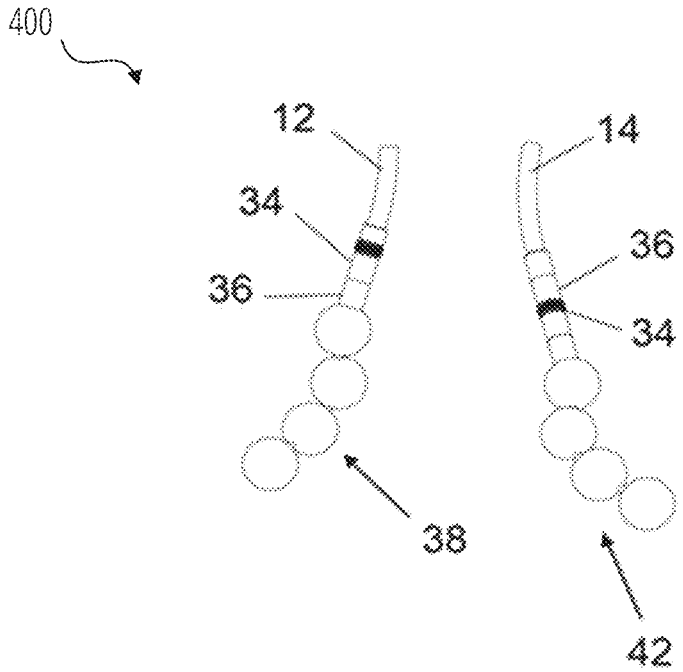
FIG. 11 is an enlarged perspective view of the screw type coupling mechanism with the first and second securing ends of FIG. 10 of showing attachable first and second decorations being decoupled from the drawstring system of FIG. 1, according to an embodiment of the present disclosure.

With reference to FIGS. 10 and 11, a partial view of an assembly 400 is shown. The assembly 400 includes the drawstring system 10 with the flexible elongated members 12, 14, the mechanical fasteners 34, 36, and the decorative elements 38, 42. In some embodiments, the open end 16 of the first flexible elongated member 12 is secured or fixed to male mechanical fastener 34, and the open end 20 of the second flexible elongated member 14 is secured or fixed to the female mechanical fastener 36. In some embodiments, the decorative element 38 is secured or fixed to the female mechanical fastener 36 and is configured to removably couple to the male mechanical fastener 34 attached to the open end 16. In some embodiments, the decorative element 42 is secured or fixed to the male mechanical fastener 34 and is configured to removably couple to the female mechanical fastener 36 attached to the open end 20. In some embodiments, the male mechanical fastener 34 that is attached to the open end 16 is operable to be removably coupled to the female mechanical fastener 36 that is attached to the open end 20.

In some embodiments, the assembly 400 shown in FIG. 11 is preassembled and provided together with a garment, such as a hoodie or a pair of sweatpants. For example, the assembly 400 may be assembled and installed in a garment by a manufacturer such that a customer purchases the garment withy the assembly preinstalled. In some embodiments, an effective length of the flexible elongated members 12, 14 from the open end 16 to the open end 20 is selected and set to be shorter than a total length of a drawstring channel associated with the garment. In some embodiments, an effective length of the flexible elongated members 12, 14 from the open end 16 to the open end 20 is selected and set such that the mechanical fasteners 34, 36 attached to the decorative elements 38, 42 as shown in FIG. 11 are both within the drawstring channel and hidden from view outside of the garment. In some embodiments, an effective length of the flexible elongated members 12, 14 from the open end 16 to the open end 20 is selected and set such that the decorative elements 38, 42 as shown in FIG. 11 are both partially withdrawn into drawstring channel and hidden from view outside of the garment.

In some embodiments, the assembly 400 is sold separately from the garment, or is not pre-installed onto the garment. A customer or end user may install the assembly 400 onto or into a garment using any of the drawstring systems described herein in order to adjust an effective length of the drawstring such that some or all portions of the mechanical fasteners 34, 36 are hidden within the drawstring channel. In some embodiments, the drawstring systems described herein may be used to further adjust (i.e., shorten) the effective length of the drawstring such that portions of the decorative elements reside within the drawstring channel to give the external appearance that the entire drawstring is made up of the decorative element. It will be understood by one skilled in the art that any combination of adjustable drawstring system, mechanical fasteners (e.g., 34, 34A, 34B, 34C, 134, 134D, 234, 234D, 36, 36A, 36B, 36C, 136, 136D, 236, 236D, etc.), and decorative elements (e.g., 38, 42, 150, 250, etc.) may be used as part of the assembly.

Figure 12:
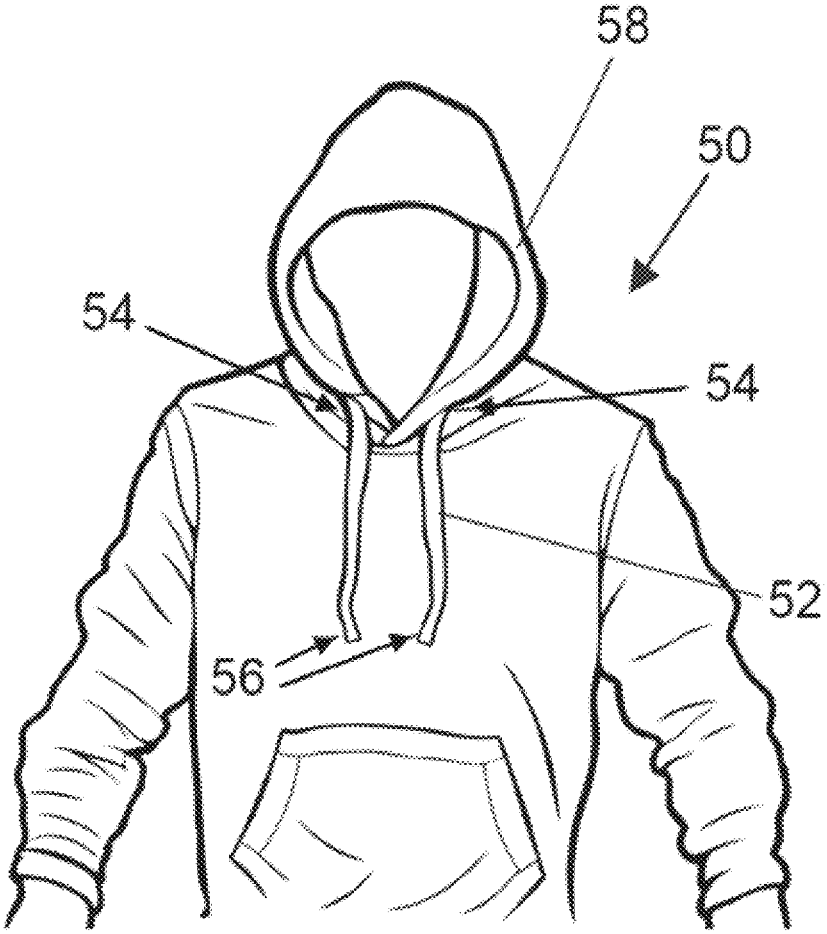
FIG. 12 is a front view of a hoodie garment showing a body portion, a hood portion, drawstring channel openings, and a full length drawstring.

Referring to FIG. 12, a hoodie garment 50 is shown with a conventional drawstring 52 positioned around the base of the hood portion, around the wearer's neck, and located within a drawstring channel (not shown) formed within the garment. The conventional drawstring 52 extends from the drawstring channel at channel openings 54. As is well known, the conventional drawstring 52 includes open ends 56, which may be pulled down to cause the rim and face portion 58 of the hood portion to clinch closed, thereby forcing fabric to close in around the wearer's face, to help the wearer keep warm, or help conceal his or her face.

Figure 13:
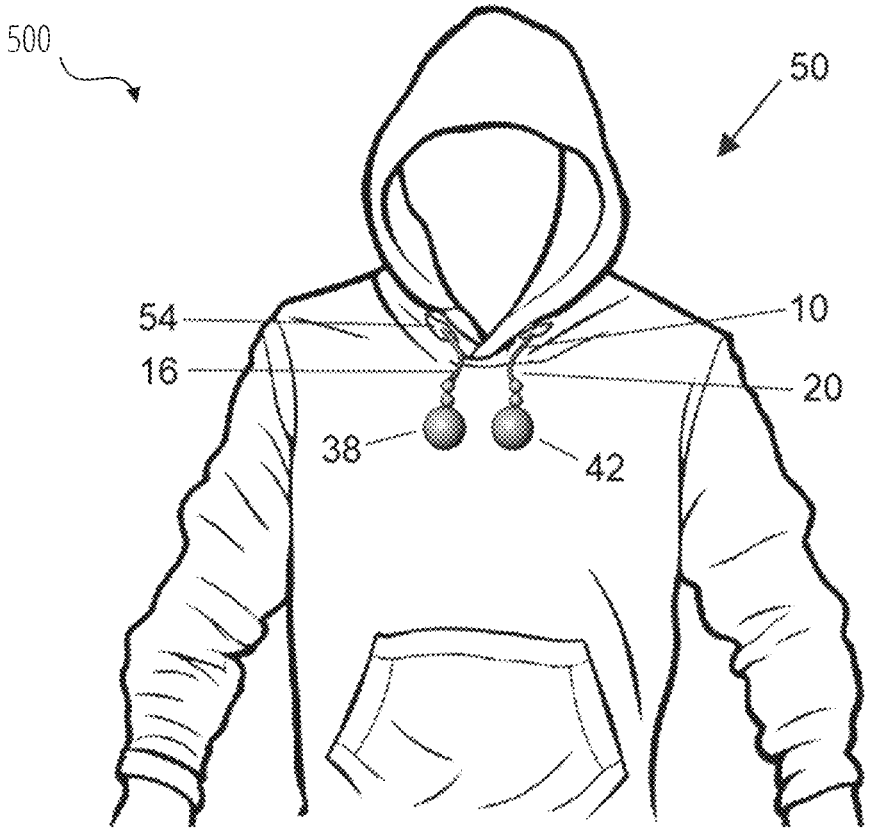
FIG. 13 is a front view of a hoodie garment with the adjustable drawstring system of FIG. 1 supporting two attached ornaments and the adjustable drawstring system is placed in an extended position such that the two attached ornaments are dangling away from the drawstring channel openings.

Referring to FIG. 13, an assembly 500 including a hoodie, adjustable drawstring system, mechanical fasteners and decorative elements is shown. In accordance with embodiments of the present disclosure, the adjustable drawstring system 10 disclosed herein replaces the convention drawstring 52 and is installed in the hoodie garment 50 of FIG. 12. The drawstring system includes select decorative elements 38, 42 attached to the open ends 16, 20. Although the adjustable drawstring system 10 is shown as being installed in the hoodie garment 50, it will be understood by one skilled in the art that any of the other adjustable drawstring systems described herein may be installed into a hoodie garment 50, or any other garments with drawstring channels, in a similar manner.

Figure 14:
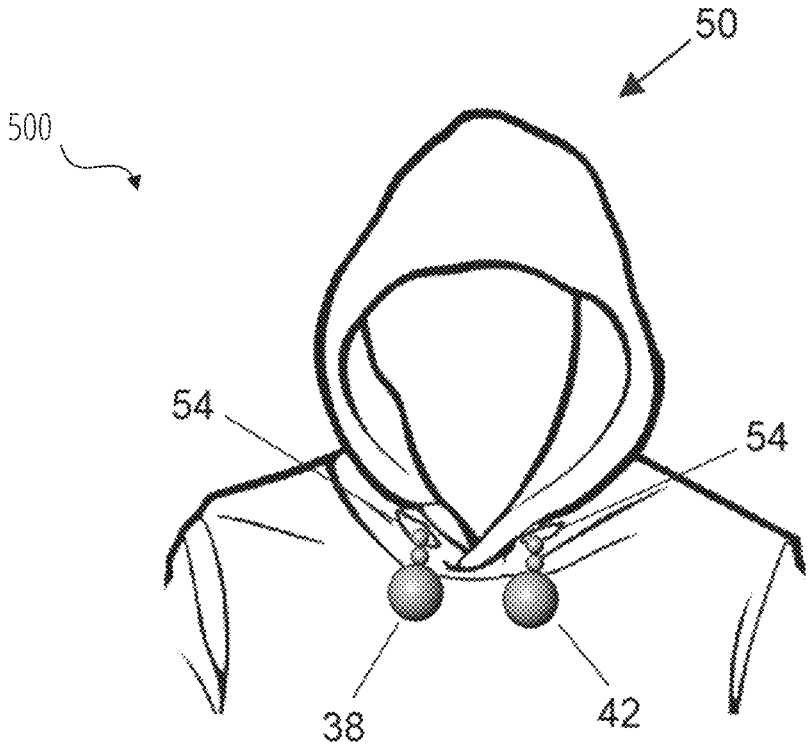
FIG. 14 is a front view of the exemplary hoodie garment of FIG. 13, showing the adjustable drawstring system placed in a retracted position such that the two attached ornaments are residing close to the drawstring channel openings.
Figure 15:
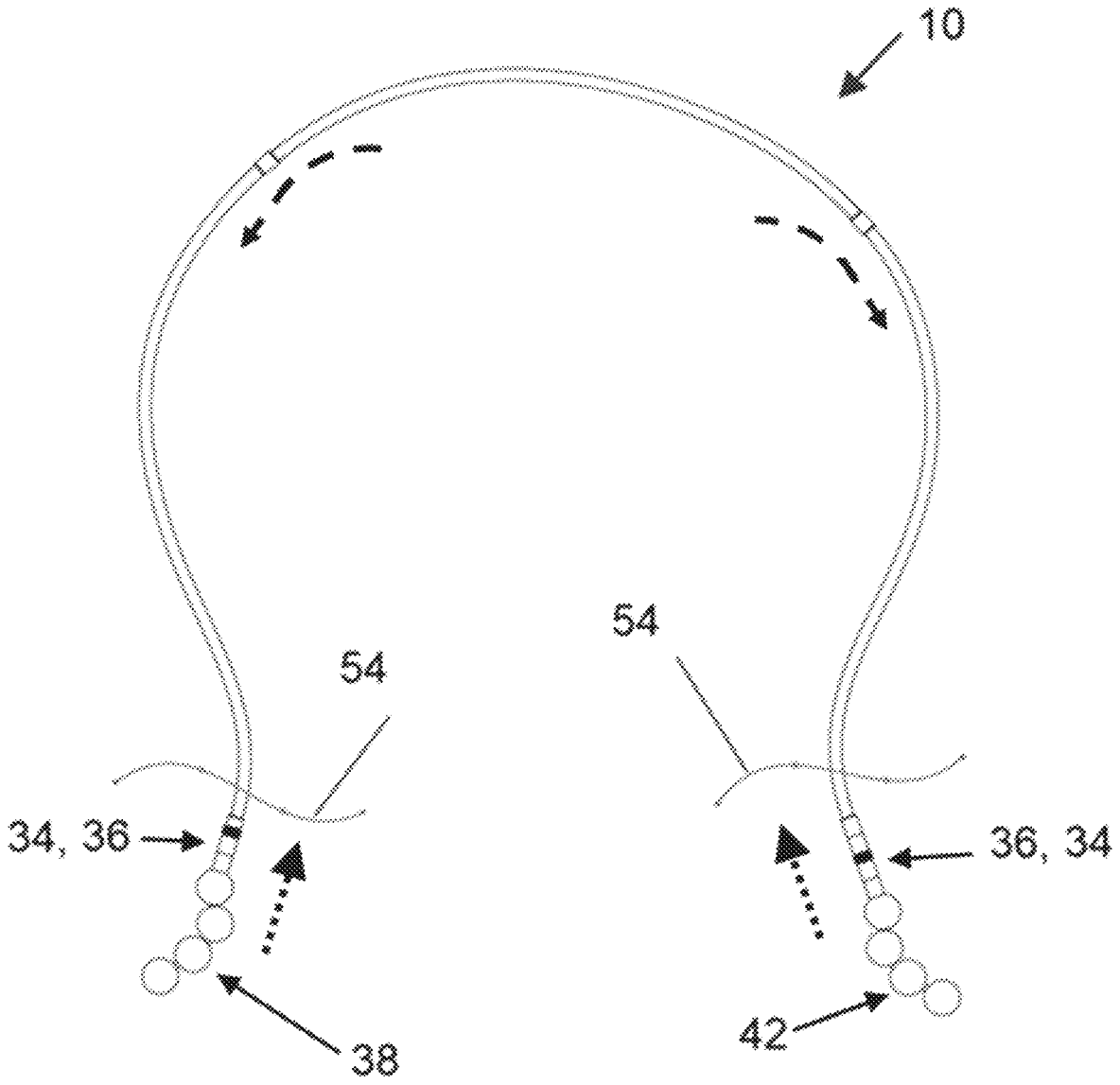
FIG. 15 is a plan view of the adjustable drawstring assembly of FIG. 1, shown in the extended position, and the selectively attachable ornaments are located away from the drawstring channel openings (represented as curved lines), according to an embodiment of the present disclosure.
Figure 16:
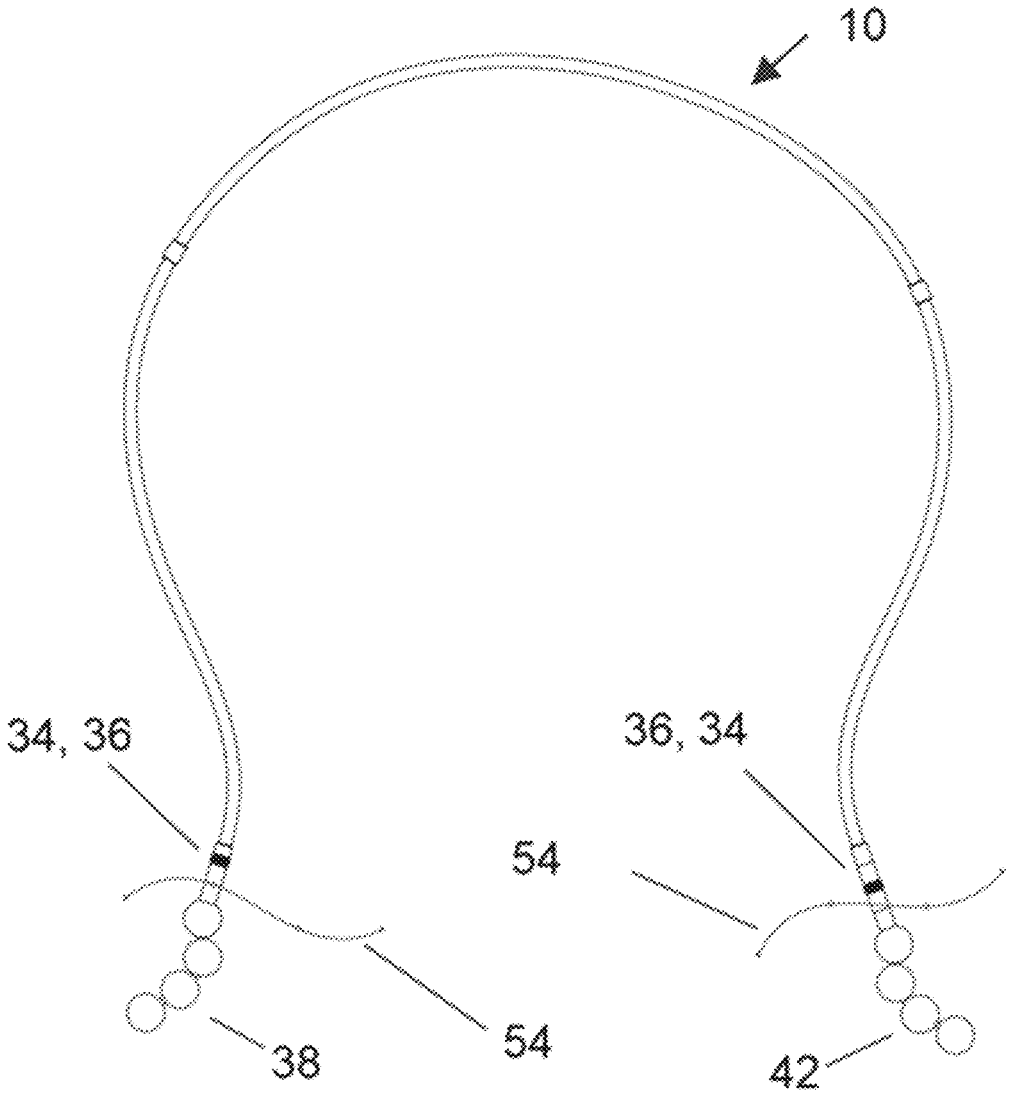
FIG. 16 is a plan view of the adjustable drawstring assembly of FIG. 15, shown in the retracted position, and the selectively attachable ornaments are located immediately adjacent to the drawstring channel openings (represented as curved lines), according to an embodiment of the present disclosure.

In FIGS. 13 and 15, the flexible elongated members 12, 14 of the adjustable drawstring system 10 is shown a bit loose on purpose to illustrate the appearance of the mechanical fasteners for the decorative elements 38, 42 when the effective length of the flexible elongated members 12, 14 are adjusted such that the open ends 16, 20 are outside of the drawstring channel. Note that decorative elements 38, 42 hang low upon the wearer's chest, showing a portion of the flexible elongated members 12, 14 between each decorative element and channel openings 54. Of course, the wearer can use the adjustable drawstring system 10 in this manner, but according to the present disclosure (with the adjustable sliding elements disclosed herein), the wearer has an option to selectively shorten the effective length of the combined flexible elongated members 12, 14 so that decorative elements pull up tighter against the garment (and channel openings 54), so that the mechanical fasteners 34, 34A, 34B, 34C, 134, 134D, 234, 234D, 36, 36A, 36B, 36C, 136, 136D, 236, 236D are concealed within the garment, as shown in FIGS. 14 and 16.

In use, the user can first adjust the drawstring, as described above, to a proper length. The user can then insert the drawstring into either of the channel openings 54 and then feed it though the channel (not shown) provided in the garment until it is properly positioned (e.g., around the rim of the hoodie). The user can then secure a decorative element 38 to the open end 16 of the first flexible elongated member 12. The user can provide access to the open end 16 by pushing the garment fabric back to expose the open end 16 and the fastener 34. They can then secure the decorative element 42 to the fastener 36 at open end 20 of the second flexible elongated member 14, again providing access to fastener 36 by pushing back the garment fabric. Once both decorative elements are secured to their respective open ends 16, 20, the user can put on the garment. As the garment settles in place, the mechanical fasteners 34, 34A, 34B, 34C, 34D, 36, 36A, 36B, 36C, 36D will retract into the channel of the garment, passing through each respective channel opening 54, and become hidden from view, as shown in FIG. 14.

The user can easily detach a decorative element 38, 42 by holding one and push the garment fabric away therefrom, thereby exposing and providing access to the mechanical fasteners 34, 34A, 34B, 34C, 34D, 36, 36A, 36B, 36C, 36D and reattach another decoration, in the same manner as described above.

The desired end result, according to the present disclosure, is that the drawstring systems described herein enable the decorative elements remain in view while allowing for the open ends of the flexible elongated members to be hidden such that the garment is gracefully and purposefully adorned, according to the particular style sought.

Even though open ends 16, 20 of the flexible elongated members 12, 14 can be hidden, according to the present disclosure, they remain adjustable while supporting the decorative elements 38, 42, it still remains functional. If the wearer requires the functional use of the flexible elongated members 12, 14, the wearer can pull down on both decorative elements so that the flexible elongated members 12, 14 become cinched around the garment opening (hoodie), functioning as a conventional drawstring. In this orientation, the attached decorative elements will reside lower on the user's chest while the flexible elongated members 12, 14 of the adjustable drawstring system 10 remains in this extended position. The user can reset the drawstring simply by stretching out the garment around the opening (e.g., hoodie) so that the flexible elongated members 12, 14 of the adjustable drawstring system 10 can again retract back into the garment fabric, and the ornament can again tighten up and be retracted back against channel openings 54.

Figure 17:
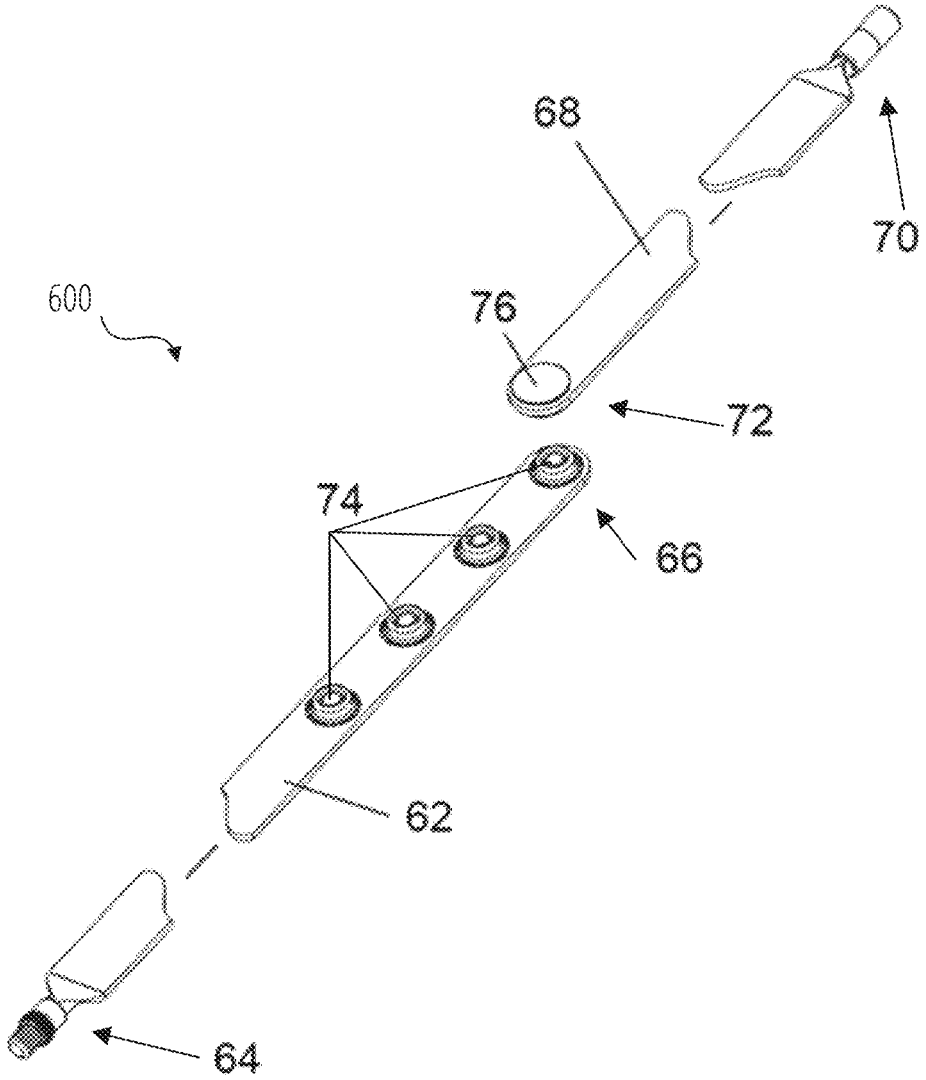
FIG. 17 is an enlarged perspective assembly view of an adjustable drawstring system with a first flat cord having a first securing end with at least one mating snap fastener, a second flat cord having a second securing end with at least one mating snap fastener (the cords are shown broken due to their length), according to an embodiment of the present disclosure.

Referring to FIG. 17, another system and method of providing longitudinal length adjustability to a drawstring is shown. In particular, a drawstring system 600 includes a first flat cord 62 and a second flat cord 68. The first flat cord 62 has an open end 64 and a securing end 66 opposite from the open end 64. The second flat cord 68 has an open end 70 and a securing end 72 opposite from the open end 70. The first flat cord 62 is similar to the first flexible elongated member 12 of the adjustable drawstring system 10 described herein, while the second flat cord 68 is similar to the second flexible elongated member 14 of the adjustable drawstring system 10. In some embodiments, the securing end 66 is provided with a plurality of snap fasteners spaced along the first flat cord 62. In some embodiments, the plurality of snap fasteners is provided along a length of about 3 to 10 inches (about 7.5 to 25.5 cm) along the first flat cord 62. In some embodiments, each snap fastener of the plurality of snap fasteners are spaced apart from an adjacent snap fastener by another by about 0.5 to 2 inches (about 1.25 to 5 cm). In some embodiments, the securing end 66 is provided with about 3, 4, 5, 6, 7, 8, 9, or 10 snap fasteners. In some embodiments, the securing end 66 includes 4 snap fasteners.

In some embodiments, the securing end 72 is provided with one or more snap fasteners spaced along the second flat cord 68, and the snap fastener(s) of the second cord 68 are configured to engage with one or more snap fastener(s) of the first flat cord 62. In some embodiments, the plurality of snap fasteners is provided along a length of about 3 to 10 inches (about 7.5 to 25.5 cm) along the second flat cord 68. In some embodiments, each snap fastener of the plurality of snap fasteners are spaced apart from an adjacent snap fastener by another by about 0.5 to 2 inches (about 1.25 to 5 cm). In some embodiments, the securing end 72 is provided with about 2, 3, or 4 snap fasteners. In some embodiments, the securing end 72 is provided with a single snap fastener.

In some embodiments, the first flat cord 62 includes at least two male snap fasteners 74, spaced apart along a length of the first flat cord 62, near the securing end 66. The second flat cord 68 includes at least one female snap fastener 76, spaced apart along the cord, near securing end 72. Both male and female sets of fasteners are equally spaced so that at least one pair of snap fasteners 74, 76 can align with each other, and selectively engage with one another, when desired. The open ends 64, 70 may function the same as the open ends 16, 20 of the above-described first embodiment and include appropriate mechanical fasteners for selective attachment to decorative elements, not shown in this figure. In use, the user can align the female snap fastener 76 of the second flat cord 68 with any one of the at least two male snap fasteners 74 of the first flat cord 62 and engage the aligned fasteners to secure of the two flat cords 62, 68 together at a set predetermined length. The different engagements of snap fasteners will provide different, but predetermined effective lengths for the combined flat cords 62, 68. The effective length of the combined flat cords 62, 68 of the drawstring system 600 can be selectively chosen by engaging specific snap fasteners and can therefore adjust the desired location of attached decorative elements with respect to the particular garment, as described in the above-described first embodiment of the present disclosure. The user preferably adjusts the two flat cords 62, 68 to the proper length outside the garment and then installs drawstring system 60 into the channel of the garment. Decorative elements may then be attached to the open ends 64, 70 using mechanical fasteners in a fashion similar to how decorative elements are attached to the open ends 16, 20 described above. In some embodiments, any of the mechanical fasteners described herein may be pre-installed onto the open ends 67, 70.

Figure 18:
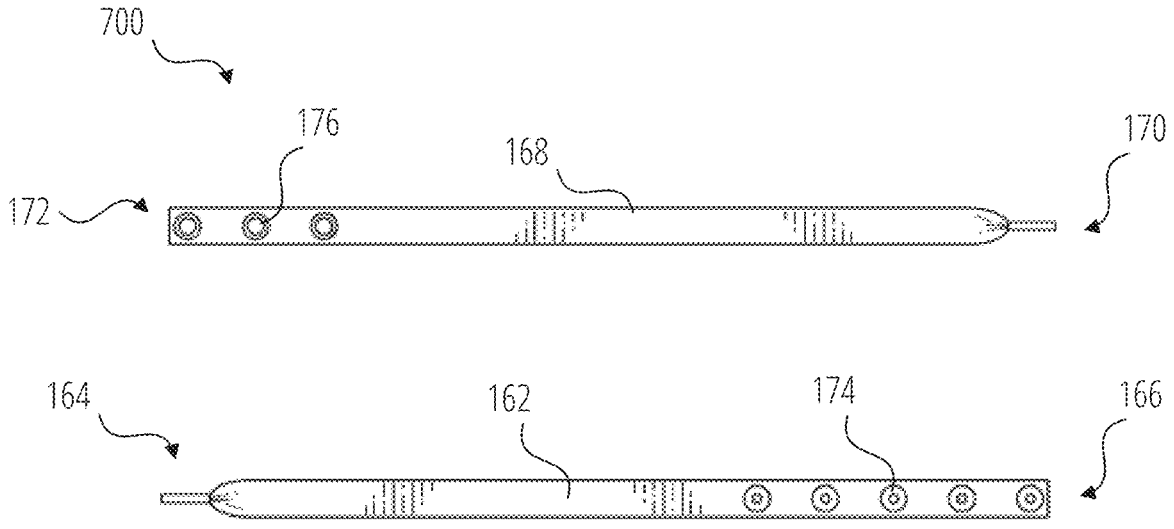
FIG. 18 is a top view of an adjustable drawstring system with a first flat cord having a first securing end with at least one mating snap fastener, a second flat cord having a second securing end with at least one mating snap fastener according to an embodiment of the present disclosure.
Figure 19:
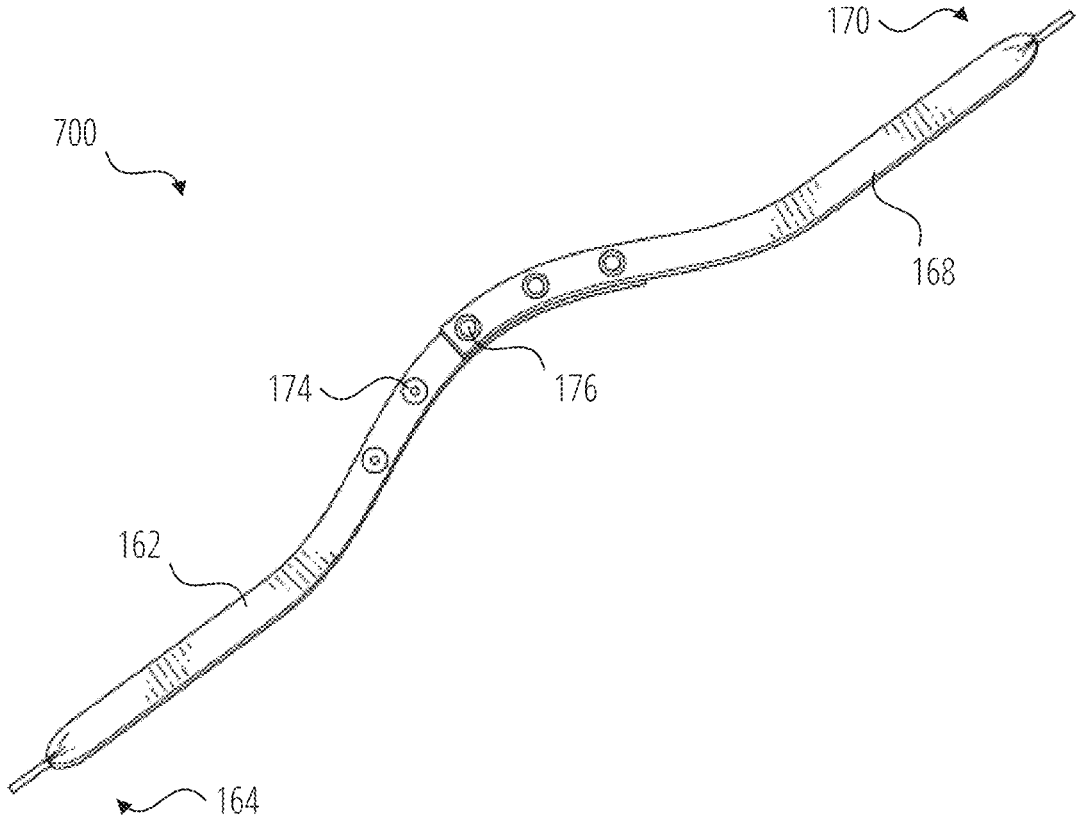
FIG. 19 is a perspective view of the adjustable drawstring system of FIG. 18 with the first flat cord being secured to the second flat cord via at least one pair of mating snap fasteners.

Referring to FIGS. 18 and 19, another system and method of providing longitudinal length adjustability to a drawstring is shown. In particular, a drawstring system 700 includes a first flat cord 162 and a second flat cord 168. The first flat cord 162 has an open end 164 and a securing end 166 opposite from the open end 164. The second flat cord 168 has an open end 170 and a securing end 172 opposite from the open end 170. The first flat cord 62 is similar to the first flexible elongated member 12 of the adjustable drawstring system 10 described herein, while the second flat cord 168 is similar to the second flexible elongated member 14 of the adjustable drawstring system 10. In some embodiments, the securing end 166 is provided with a plurality of male snap fasteners 174 spaced along the first flat cord 162. In some embodiments, the plurality of male snap fasteners is provided along a length of about 3 to 10 inches (about 7.5 to 25.5 cm) along the first flat cord 162. In some embodiments, each snap fastener of the plurality of male snap fasteners are spaced apart from an adjacent snap fastener by another by about 0.5 to 2 inches (about 1.25 to 5 cm). In some embodiments, the securing end 66 is provided with about 3, 4, 5, 6, 7, 8, 9, or 10 male snap fasteners. In some embodiments, the securing end 66 is provided with 5 male snap fasteners.

In some embodiments, the securing end 172 is provided with one or more female snap fasteners 176 spaced along the second flat cord 168, and the female snap fastener(s) of the second cord 168 are configured to engage with one or more male snap fastener(s) of the first flat cord 162. In some embodiments, the plurality of female snap fasteners is provided along a length of about 3 to 10 inches (about 7.5 to 25.5 cm) along the second flat cord 168. In some embodiments, each female snap fastener of the plurality of snap fasteners are spaced apart from an adjacent snap fastener by another by about 0.5 to 2 inches (about 1.25 to 5 cm). In some embodiments, the securing end 72 is provided with about 2, 3, or 4 female snap fasteners. In some embodiments, the securing end 72 is provided with 3 female snap fasteners.

As shown in FIG. 19, the combination of male and female snap fasteners 174, 176 may be selectively engaged to adjust an effective length of the flat cords 162, 168 extending from the open end 164 to the open end 170. The effective length of the combined flat cords 162, 168 of the drawstring system 60 can be selectively chosen by engaging specific snap fasteners and can therefore adjust the desired location of attached decorative elements with respect to the particular garment, as described in the above-described first embodiment of the present disclosure. The user preferably adjusts the two flat cords 162, 168 to the proper length outside the garment and then installs drawstring system 700 into the channel of the garment.

The open ends 164, 170 may be attached to any of the mechanical fastener systems described herein such that decorative elements can be removably attached to the open ends 164, 170. For example, the open end 164 may be inserted into and fixed to the proximal end of male mechanical fastener 134, and the open end 170 may be inserted into and fixed to the proximal end of the female mechanical fastener 136 as shown in FIG. 7. Decorative elements may then be attached to the open ends 64, 70 using mechanical fasteners in a fashion similar to how decorative elements are attached to the open ends 16, 20 described above. In some embodiments, any of the mechanical fasteners described herein may be pre-installed onto the open ends 164, 170.

Figure 20:
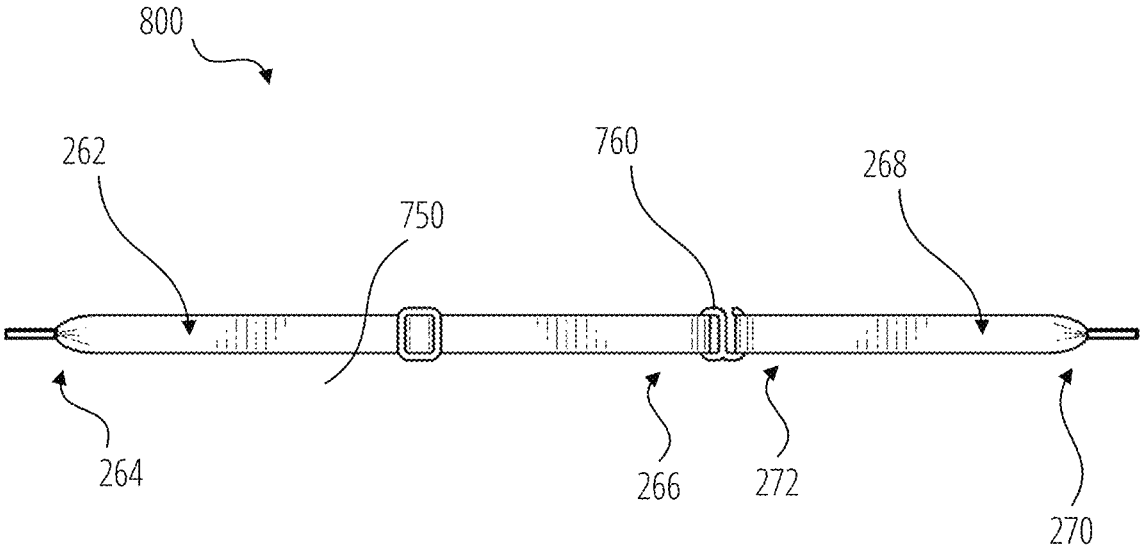
FIG. 20 is a top view of an adjustable drawstring system with a first flat cord including a tri-bar adjuster and a second flat cord coupled to the first flat cord via and end loop according to an embodiment of the present disclosure.
Figure 21:
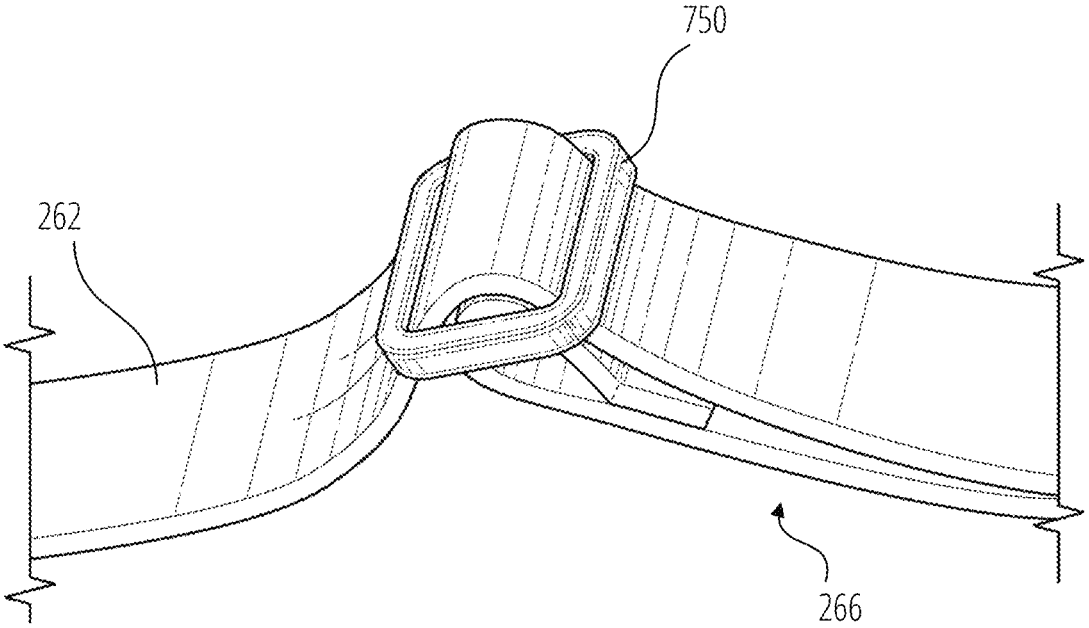
FIG. 21 is an enlarged perspective view of the tri-bar adjuster.

Referring to FIG. 20, another system and method of providing longitudinal length adjustability to a drawstring is shown. In particular, a drawstring system 800 includes a first flat cord 262 and a second flat cord 268. The first flat cord 262 has an open end 264 and a securing end 266 opposite from the open end 64. The second flat cord 268 has an open end 270 and a securing end 272 opposite from the open end 270. The first flat cord 262 is similar to the first flexible elongated member 12 of the adjustable drawstring system 10 described herein, while the second flat cord 268 is similar to the second flexible elongated member 14 of the adjustable drawstring system 10. In some embodiments, the securing end 66 is provided with a tri-bar adjuster 750 and an end loop 760. A length of the first flat cord 262 is threaded through the tri-bar adjuster 750, is looped through the end loop 760, and the securing end 66 is fixed to the tri-bar adjuster 750. The tri-bar adjuster 750 is operable to slide and selectively be positioned along the length of the first flat cord 262 such that the effective length of the first flat cord 262 can be adjusted (i.e., increased or decreased in length). The securing end 272 of the second flat cord 268 is also looped through the end loop 760 thereby forming a length adjustable drawstring where an effective. length extending from the open end 264 to the open end 270 can be adjusted. In some embodiments, as shown in FIG. 20, the end loop 760 may include a g-shaped structure such that the securing end 272 of the second flat cord 268 may be removably attached to the end loop 760. In some embodiments, the g-shaped structure may be reversed such that the securing end 266 of the first flat cord 262 is removably attached to the end loop 760, while the securing end 272 of the second flat cord 268 is permanently attached to the end loop 760. In other embodiments, the end loop 760 may include an 8-shaped structure such that both securing ends 266, 272 may be permanently attached to the end loop 760. In some embodiments, the end loop 760 is a tri-bar adjuster.

The open ends 264, 270 may be attached to any of the mechanical fastener systems described herein such that decorative elements can be removably attached to the open ends 264, 270. For example, the open end 264 may be inserted into and fixed to the proximal end of male mechanical fastener 234, and the open end 270 may be inserted into and fixed to the proximal end of the female mechanical fastener 236 as shown in FIG. 7. Decorative elements may then be attached to the open ends 64, 70 using mechanical fasteners in a fashion similar to how decorative elements are attached to the open ends 16, 20 described above. In some embodiments, any of the mechanical fasteners described herein may be pre-installed onto the open ends 264, 270.

It will be appreciated by one skilled in the art that while the drawstring systems described herein are provided with adjustable flexible elongated members, such as cords, it will be understood that other elongated, flexible materials may be used in place of cords, such as for example, cables, strings, bands, ribbons, and laces.

It will also be appreciated by those skilled in the art that modifications can be made to the example embodiments described herein without departing from the invention. Structural features of systems and apparatuses described herein can be replaced with functionally equivalent parts or omitted entirely. Moreover, it will be appreciated that features from the embodiments can be combined with each other without departing from the disclosure. For example, the various adjustable drawstring systems may be used with the different fastener systems described herein to removably attach decorative elements to the adjustable drawstring systems.

What is claimed is:

1. An adjustable drawstring system comprising:

a first flexible elongated member, the first flexible elongated member including an open end and a securing end opposite from the open end of the first flexible elongated member;

a second flexible elongated member, the second flexible elongated member including an open end and a securing end opposite from the open end of the second flexible elongated member; and a securing system fixed to the securing end of the first flexible elongated member, the securing system comprising at least one adjustable securing element being operable to selectively engage and secure to different portions of the securing end of the second flexible elongated member, wherein the open end of the first flexible elongated member includes a first male mechanical fastener configured to be selectively attached to a first female mechanical fastener that is coupled to a first decorative element, and wherein the open end of the second flexible elongated member includes a second female mechanical fastener configured to be selectively attached to a second male mechanical fastener that is coupled to a second decorative element.

2. The adjustable drawstring system of claim 1, wherein the securing system of the first flexible elongated member is selectively engaged to the securing end of the second flexible elongated member such that an effective length of the first flexible elongated member and the second flexible elongated member stretched from the open end of the first flexible elongated member to the open end of the second flexible elongated member is less than an entire length of a drawstring channel of a garment.

3. The adjustable drawstring system of claim 1, wherein:

the at least one adjustable securing element a tri-bar adjuster; and the tri-bar adjuster is slidable along a length of the first flexible elongated member to adjust a position of the securing end of the first flexible elongated member relative to the securing end of the second flexible elongated member.

4. The adjustable drawstring system of claim 1, wherein:

the securing system is a first securing system; and a second securing system is fixed to the securing end of the second flexible elongated member, the second securing system comprising a second adjustable securing element operable to selectively engage and secure to different portions of the securing end of the first flexible elongated member.

5. The adjustable drawstring system of claim 4, wherein:

the at least one adjustable securing element includes at least one male snap fastener; and the second adjustable securing element includes at least one female snap fastener.

6. The adjustable drawstring system of claim 4, wherein:

the at least one adjustable securing element a first sliding element, the first sliding element including a first bore configured to slidably receive a length of the second flexible elongated member located between the open end and the securing end of the second flexible elongated member; and the second adjustable securing element is a second sliding element, the second sliding element including a second bore configured to slidably receive a length of the first flexible elongated member located between the open end and the securing end of the first flexible elongated member.

7. The adjustable drawstring system of claim 6, wherein:

the first bore of the first sliding element has a first cross-sectional area;

the length of the second flexible elongated member has a second cross-sectional area; and the second cross-sectional area is greater than or equal to the first cross-sectional area to provide kinetic frictional resistance while of the second flexible elongated member is pulled through the first bore of the first sliding element.

8. The adjustable drawstring system of claim 6, wherein the first sliding element further comprises a selectively activatable lock, the selectively activatable lock including an engagement surface for engaging a surface of the length of the second flexible elongated member to prevent movement of the length of the second flexible elongated member relative to the first sliding element.

9. The adjustable drawstring system of claim 1, wherein the second female mechanical fastener is configured to be selectively attached to the first male mechanical fastener such that the first flexible elongated member and the second flexible elongated member form a closed loop to remain attached to a garment during washing or storage.

10. The adjustable drawstring system of claim 1, wherein:

the first flexible elongated member is one of a cord, cable, string, band, ribbon, or a lace; and the second flexible elongated member is one of a cord, cable, string, band, ribbon, or a lace.

11. A garment including an opening configured to be cinched, the garment comprising:

a textile material secured together to form the opening, and including a drawstring channel extending along at least portion of a perimeter of the opening; and the adjustable drawstring system of claim 1 received within the drawstring channel and having an effective length that is shorter than an entire length of the drawstring channel.

* * * * *